US009688091B2

(12) United States Patent
To et al.

(10) Patent No.: US 9,688,091 B2
(45) **Date of Patent: *Jun. 27, 2017**

(54) RING BINDER MECHANISM

(75) Inventors: Chun Yuen To, Hong Kong (CN); Ho Ping Cheng, Hong Kong (CN); Jin Biao Pi, Daye (CN)

(73) Assignee: World Wide Stationery Mfg. Co., Ltd., Kwai Chung, New Territories (HK)

( * ) Notice: Subject to any disclaimer, the term of this patent is extended or adjusted under 35 U.S.C. 154(b) by 852 days.

This patent is subject to a terminal disclaimer.

(21) Appl. No.: 12/843,437

(22) Filed: Jul. 26, 2010

(65) Prior Publication Data

US 2010/0284729 A1 Nov. 11, 2010

Related U.S. Application Data

(63) Continuation of application No. 11/932,150, filed on Oct. 31, 2007, now Pat. No. 7,819,602.

(51) Int. Cl.
*B42F 13/26* (2006.01)

(52) U.S. Cl.
CPC ..... *B42F 13/26* (2013.01)

(58) Field of Classification Search
USPC ..... 402/38, 41, 43
See application file for complete search history.

(56) References Cited

U.S. PATENT DOCUMENTS 566,717 A 8/1896 Krah
651,254 A 6/1900 Krah
683,019 A 9/1901 Buchanan
790,382 A 5/1905 McBride
857,377 A 6/1907 Baker
974,831 A 11/1910 Scherzinger
1,163,179 A 12/1915 Schade, Jr.
(Continued)

FOREIGN PATENT DOCUMENTS

BE 824649 A1 5/1975
FR 1385285 A 1/1965

OTHER PUBLICATIONS

Cyber Comfort Ad Sheet, Apr. 2003, 2 pgs, World Wide Stationery Mfg. Co., Ltd., Hong Kong.
(Continued)

*Primary Examiner* — Matthew G Katcoff
(74) *Attorney, Agent, or Firm* — Senninger Powers LLP

(57) ABSTRACT

A ring binder has housing including a central portion and lateral sides. Hinge plates are held between the lateral sides of the housing. Each of multiple rings includes at least one ring member mounted for movement with the hinge plates between closed and open positions. An actuator is mounted for pivotal movement relative to the housing and engageable with the hinge plates for opening rings. In one embodiment, the housing defines a stop engaged by the actuator upon arrival of the actuator at a terminal position when the actuator has opened the rings. The engagement between the surface of the actuator and the stop limits pivoting movement of the actuator relative to the housing in the opening direction beyond the terminal position. In another embodiment, the actuator is constructed for quicker response of the binder to movement of the actuator to open the rings.

15 Claims, 19 Drawing Sheets

(56) References Cited

U.S. PATENT DOCUMENTS

| | | | |
|---|---|---|---|
| 1,398,034 | A | 11/1921 | Mero |
| 1,398,388 | A | 11/1921 | Murphy |
| 1,733,548 | A | 10/1929 | Martin |
| 1,733,894 | A | 10/1929 | Martin |
| 1,787,957 | A | 1/1931 | Schade |
| 1,953,981 | A | 4/1934 | Trussell |
| 1,991,362 | A | 2/1935 | Krag |
| 1,996,463 | A | 4/1935 | Dawson et al. |
| 2,004,570 | A | 6/1935 | Dawson |
| 2,013,416 | A | 9/1935 | McClure |
| 2,024,461 | A | 12/1935 | Lotter |
| 2,075,766 | A | 3/1937 | Rand |
| 2,089,211 | A | 8/1937 | Krag |
| 2,096,944 | A | 10/1937 | Unger et al. |
| 2,103,307 | A | 12/1937 | Unger |
| 2,105,235 | A | 1/1938 | Schade |
| 2,158,056 | A | 5/1939 | Cruzan |
| 2,179,627 | A | 11/1939 | Handler |
| 2,204,918 | A | 6/1940 | Trussell |
| 2,218,105 | A | 10/1940 | Griffin |
| 2,236,321 | A | 3/1941 | Ostrander |
| 2,239,121 | A | 4/1941 | St. Louis et al. |
| 2,242,035 | A | 5/1941 | Koelling |
| 2,252,422 | A | 8/1941 | Unger |
| 2,260,929 | A | 10/1941 | Bloore |
| 2,288,189 | A | 6/1942 | Guinane |
| 2,304,716 | A | 12/1942 | Supin |
| 2,311,492 | A | 2/1943 | Unger |
| 2,322,595 | A | 6/1943 | Schade |
| 2,421,799 | A | 6/1947 | Martin |
| 2,528,866 | A | 11/1950 | Dawson, Jr. |
| 2,612,169 | A | 9/1952 | Segal |
| 2,865,377 | A | 12/1958 | Schroer et al. |
| 2,871,711 | A | 2/1959 | Stark |
| 2,891,553 | A | 6/1959 | Acton |
| 2,950,719 | A | 8/1960 | Lyon |
| 3,077,888 | A | 2/1963 | Thieme |
| 3,098,489 | A | 7/1963 | Vernon |
| 3,098,490 | A | 7/1963 | Wance |
| 3,101,719 | A | 8/1963 | Vernon |
| 3,104,667 | A | 9/1963 | Mintz |
| 3,149,636 | A | 9/1964 | Rankin |
| 3,190,293 | A | 6/1965 | Schneider et al. |
| 3,205,894 | A | 9/1965 | Rankin |
| 3,205,895 | A | 9/1965 | Johnson |
| 3,255,759 | A | 6/1966 | Dennis |
| 3,348,550 | A | 10/1967 | Wolf et al. |
| 3,718,402 | A | 2/1973 | Schade |
| 3,728,036 | A | 4/1973 | Cott |
| 3,748,051 | A | 7/1973 | Frank |
| 3,884,586 | A | 5/1975 | Michaelis et al. |
| 3,954,343 | A | 5/1976 | Thomsen |
| 3,993,374 | A | 11/1976 | Schudy et al. |
| 4,127,340 | A | 11/1978 | Almgren |
| 4,130,368 | A | 12/1978 | Jacoby et al. |
| 4,352,582 | A | 10/1982 | Eliasson |
| 4,522,526 | A | 6/1985 | Lozfau et al. |
| 4,566,817 | A | 1/1986 | Barrett, Jr. |
| 4,571,108 | A | 2/1986 | Vogl |
| 4,696,595 | A | 9/1987 | Pinkney |
| 4,798,491 | A | 1/1989 | Lassle |
| 4,813,803 | A | 3/1989 | Gross |
| 4,815,882 | A | 3/1989 | Ohminato |
| 4,886,390 | A | 12/1989 | Silence et al. |
| 4,919,557 | A | 4/1990 | Podosek |
| 5,067,840 | A | 11/1991 | Cooper et al. |
| 5,116,157 | A | 5/1992 | Gillum et al. |
| 5,135,323 | A | 8/1992 | Pinheiro |
| 5,180,247 | A | 1/1993 | Yu |
| 5,255,991 | A | 10/1993 | Sparkes |
| 5,286,128 | A | 2/1994 | Gillum |
| 5,346,325 | A | 9/1994 | Yamanoi |
| 5,354,142 | A | 10/1994 | Yu |
| 5,368,407 | A | 11/1994 | Law |
| 5,378,073 | A | 1/1995 | Law |
| 5,393,155 | A | 2/1995 | Ng |
| 5,393,156 | A | 2/1995 | Mullin et al. |
| 5,476,335 | A | 12/1995 | Whaley |
| 5,577,852 | A | 11/1996 | To |
| 5,660,490 | A | 8/1997 | Warrington |
| 5,692,847 | A | 12/1997 | Zane et al. |
| 5,692,848 | A | 12/1997 | Wada |
| 5,718,529 | A | 2/1998 | Chan |
| 5,782,569 | A | 7/1998 | Mullin et al. |
| 5,788,392 | A | 8/1998 | Cheung |
| 5,807,006 | A | 9/1998 | Cheung |
| 5,810,499 | A | 9/1998 | Law |
| 5,816,729 | A | 10/1998 | Whaley |
| 5,868,513 | A | 2/1999 | Law |
| 5,879,097 | A | 3/1999 | Cheng |
| 5,904,435 | A | 5/1999 | Tung |
| 5,957,611 | A | 9/1999 | Whaley |
| 5,975,785 | A | 11/1999 | Chan |
| 6,036,394 | A | 3/2000 | Cheng |
| 6,146,042 | A | 11/2000 | To et al. |
| 6,206,601 | B1 | 3/2001 | Ko |
| 6,217,247 | B1 | 4/2001 | Ng |
| 6,270,279 | B1 | 8/2001 | Whaley |
| 6,276,862 | B1 | 8/2001 | Snyder et al. |
| 6,293,722 | B1 | 9/2001 | Holbrook et al. |
| 6,364,558 | B1 | 4/2002 | To |
| 6,467,984 | B1 | 10/2002 | To |
| 6,474,897 | B1 | 11/2002 | To |
| 6,533,486 | B1 | 3/2003 | To |
| 6,749,357 | B2 | 6/2004 | Cheng |
| 6,840,695 | B2 | 1/2005 | Horn |
| 7,223,040 | B2 | 5/2007 | Koike et al. |
| 7,270,496 | B2 | 9/2007 | Morgan et al. |
| 7,296,946 | B2 | 11/2007 | Cheng et al. |
| 7,331,732 | B2 | 2/2008 | Kaneda |
| 7,404,685 | B2 | 7/2008 | Cheng |
| 7,478,963 | B2 | 1/2009 | Tanaka et al. |
| 7,534,064 | B2 | 5/2009 | Cheng |
| 7,549,817 | B2 | 6/2009 | Cheng et al. |
| 7,648,302 | B2 | 1/2010 | Zhang et al. |
| 7,661,899 | B2 | 2/2010 | Lin |
| 7,665,926 | B2 | 2/2010 | Cheng |
| 7,674,062 | B2 | 3/2010 | Horn |
| 7,748,922 | B2 | 7/2010 | Cheng |
| 2002/0076262 | A1 | 6/2002 | To |
| 2005/0013654 | A1* | 1/2005 | Cheng et al. ..... 402/36 |
| 2005/0201817 | A1 | 9/2005 | Cheng |
| 2005/0201818 | A1 | 9/2005 | Cheng |
| 2006/0008318 | A1 | 1/2006 | Ng |
| 2006/0216107 | A1* | 9/2006 | Lin ..... 402/38 |
| 2006/0251467 | A1 | 11/2006 | Cheng |
| 2007/0086836 | A1 | 4/2007 | Cheng |
| 2007/0134054 | A1 | 6/2007 | Li |
| 2008/0008519 | A1 | 1/2008 | To |
| 2008/0075526 | A1 | 3/2008 | Ng et al. |
| 2008/0075527 | A1* | 3/2008 | Pi et al. ..... 402/41 |
| 2008/0085145 | A1 | 4/2008 | To et al. |
| 2008/0199246 | A1 | 8/2008 | To et al. |
| 2009/0035053 | A1 | 2/2009 | Pi et al. |
| 2009/0060630 | A1 | 3/2009 | To et al. |
| 2009/0060631 | A1 | 3/2009 | To et al. |

OTHER PUBLICATIONS

Office action dated Feb. 1, 2010 from U.S. Appl. No. 11/932,150, 13 pgs.

Response filed May 3, 2010 to Office action issued Feb. 1, 2010 in U.S. Appl. No. 11/932,150, 22 pgs.

Office action issued Jun. 16, 2011 in related U.S. Appl. No. 12/236,296—15 pgs.

Response filed Oct. 17, 2011 to Office Action dated Jun. 15, 2011 from related U.S. Appl. No. 12/236,296—17 pgs.

Office Action dated Feb. 11, 2016 in related Canadian Application No. 2,882,841, 3 pages.

(56) References Cited

OTHER PUBLICATIONS

Office Action dated Nov. 7, 2016 in related Canadian Application No. 2,882,841, 3 pages.

* cited by examiner

RING BINDER MECHANISM

CROSS-REFERENCE TO RELATED APPLICATION

This application is a continuation of U.S. application Ser. No. 11/932,150, filed Oct. 31, 2007, which is hereby incorporated by reference in its entirety.

FIELD OF INVENTION

This invention relates to a ring binder mechanism for retaining loose-leaf pages, and more particularly to apparatus and methods for moving ring members of the binder mechanism between their open and closed position.

BACKGROUND

A ring binder mechanism retains loose-leaf pages, such as hole-punched pages, in a file or notebook. It has ring members for retaining the pages. The ring members may be selectively opened to add or remove pages or closed to retain pages while allowing the pages to be moved along the ring members. The ring members mount on two adjacent hinge plates that join together about a pivot axis. A housing loosely supports the hinge plates within the housing and holds the hinge plates together so they may pivot relative to the housing. The housing generally has a central portion and lateral sides extending downwardly from the central portion along both sides. The hinge plates are disposed between the lateral sides of the housing, which retain the hinge plates in the housing.

When the rings are closed, it is desirable to bias the ring members to remain in their closed position. Even slight movement of the ring members toward their open position threatens unintentional release of loose-leaf pages. Slight movement of the ring members toward their open position also presents a risk that the pages will get caught on the tips of the ring members and rip as the pages are moved along the rings from one ring member to the other. Thus, the ring members are typically biased toward their closed position by a spring or other mechanism that applies a clamping force that holds the ring members together when they are in their closed position. An operator may typically overcome this force by manually pulling the ring members apart or pushing them together. Levers may also be provided on one or both ends of the housing for moving the ring members between the open and closed position.

SUMMARY

In another aspect of the invention is a ring binder mechanism for holding loose-leaf pages generally comprises an elongate housing having a central portion and lateral sides extending downwardly along either side of the central portion. A ring support includes a pair of hinge plates in generally side-by-side relation and hingedly connected to one another for pivoting movement relative to each other. The hinge plates are held between the lateral sides of the housing. The mechanism also has a plurality of rings for holding the loose-leaf pages. Each ring includes a first ring member and a second ring member. The first ring member is mounted on the ring support for movement with the ring support relative to the housing between a closed position and an open position. In the closed position, the first and second ring members form a substantially continuous, closed loop for allowing loose-leaf pages retained by the rings to be moved along the rings from one ring member to the other. In the open position, the first and second ring members form a discontinuous, open loop for adding or removing loose-leaf pages from the rings. The mechanism has an actuator mounted for pivotal movement relative to the housing about a pivot axis. The actuator has a pair of arms engageable with the hinge plates. The arms include a lower arm having a first contact surface engageable with the hinge plates during pivoting movement of the actuator in a first direction to move the rings from the closed position to the open position and an upper arm having a second contact surface engageable with the hinge plates during pivoting movement of the actuator in a second direction opposite said first direction to move the rings from the open position to the closed position. The first contact surface is located farther from the pivot axis than the second contact surface.

In still another aspect of the invention a ring binder mechanism for holding loose-leaf pages generally comprises an elongate housing having a central portion and lateral sides extending downwardly along either side of the central portion. A ring support includes a pair of hinge plates in generally side-by-side relation and hingedly connected to one another for pivoting movement relative to each other. The hinge plates are held between the lateral sides of the housing. The mechanism also has a plurality of rings for holding the loose-leaf pages. Each ring includes a first ring member and a second ring member. The first ring member is mounted on the ring support for movement with the ring support relative to the housing between a closed position and an open position. In the closed position, the first and second ring members form a substantially continuous, closed loop for allowing loose-leaf pages retained by the rings to be moved along the rings from one ring member to the other. In the open position, the first and second ring members form a discontinuous, open loop for adding or removing loose-leaf pages from the rings. The mechanism has an actuator mounted for pivotal movement relative to the housing about a pivot axis. The actuator has a pair of arms engageable with the hinge plates. The arms include an upper and a lower arm defining a notch. The hinge plates having ends that are received in the notch. The lower arm has a contact surface engageable with the hinge plates during pivoting movement of the actuator to move the rings from the closed position to the open position. The contact surface is spaced at least about 6 mm away from the pivot axis.

In yet another aspect of the invention a ring binder mechanism for holding loose-leaf pages generally comprises an elongate housing having a central portion and lateral sides extending downwardly along either side of the central portion. A ring support includes a pair of hinge plates in generally side-by-side relation and hingedly connected to one another for pivoting movement relative to each other. The hinge plates are held between the lateral sides of the housing. The mechanism also has a plurality of rings for holding the loose-leaf pages. Each ring includes a first ring member and a second ring member. The first ring member is mounted on the ring support for movement with the ring support relative to the housing between a closed position and an open position. In the closed position, the first and second ring members form a substantially continuous, closed loop for allowing loose-leaf pages retained by the rings to be moved along the rings from one ring member to the other. In the open position, the first and second ring members form a discontinuous, open loop for adding or removing loose-leaf pages from the rings. The mechanism has an actuator mounted for pivotal movement relative to the housing about a pivot axis. The actuator has an arm engageable with the hinge plates to move the rings from the closed position to the open position upon pivoting movement of the actuator through an angle in the range of about 16 degrees to about 24 degrees.

Other objects and features will in part be apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
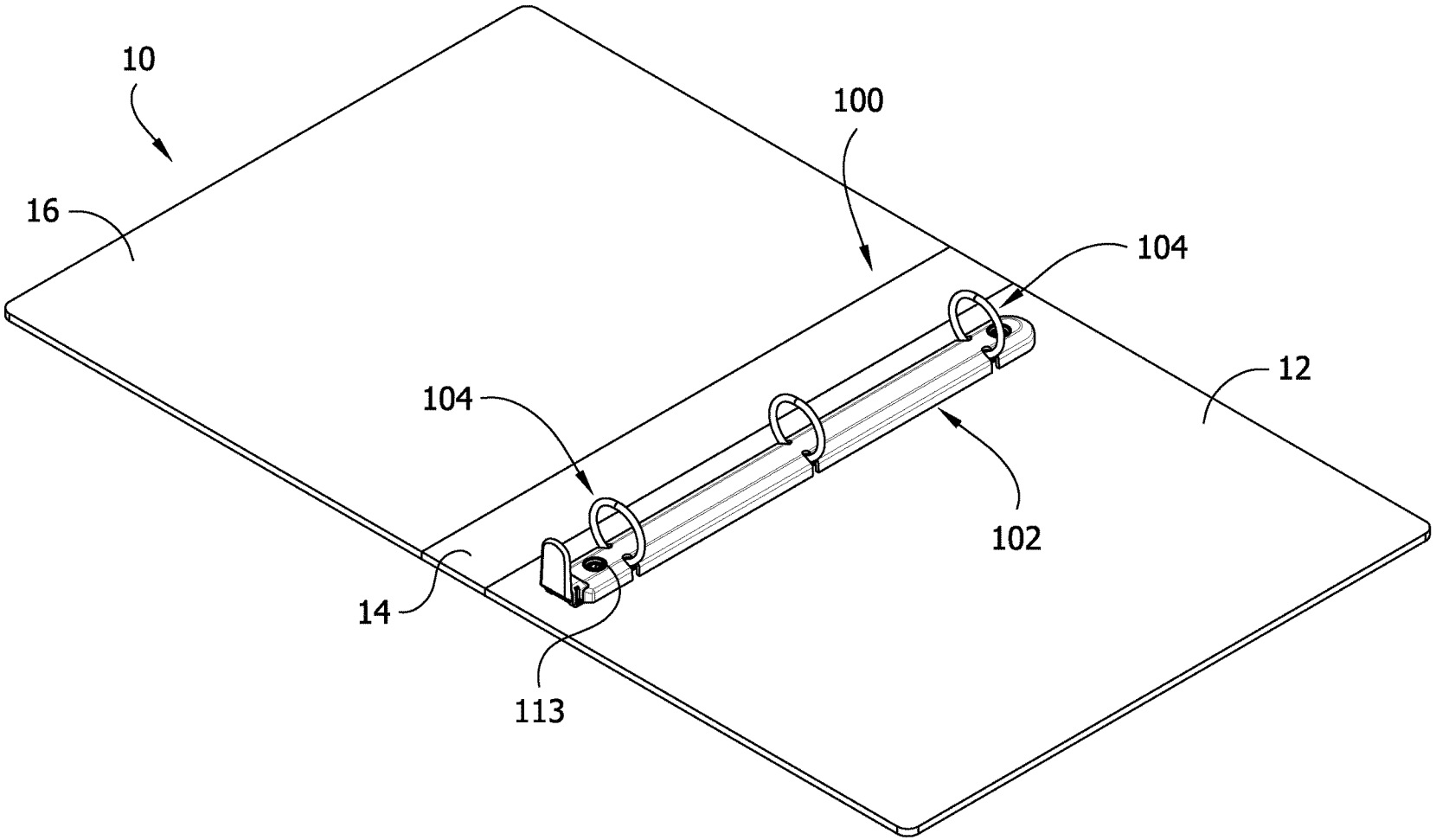
FIG. 1 is a perspective of one embodiment of a ring binder mechanism of the present invention secured to a notebook.
Figure 2:
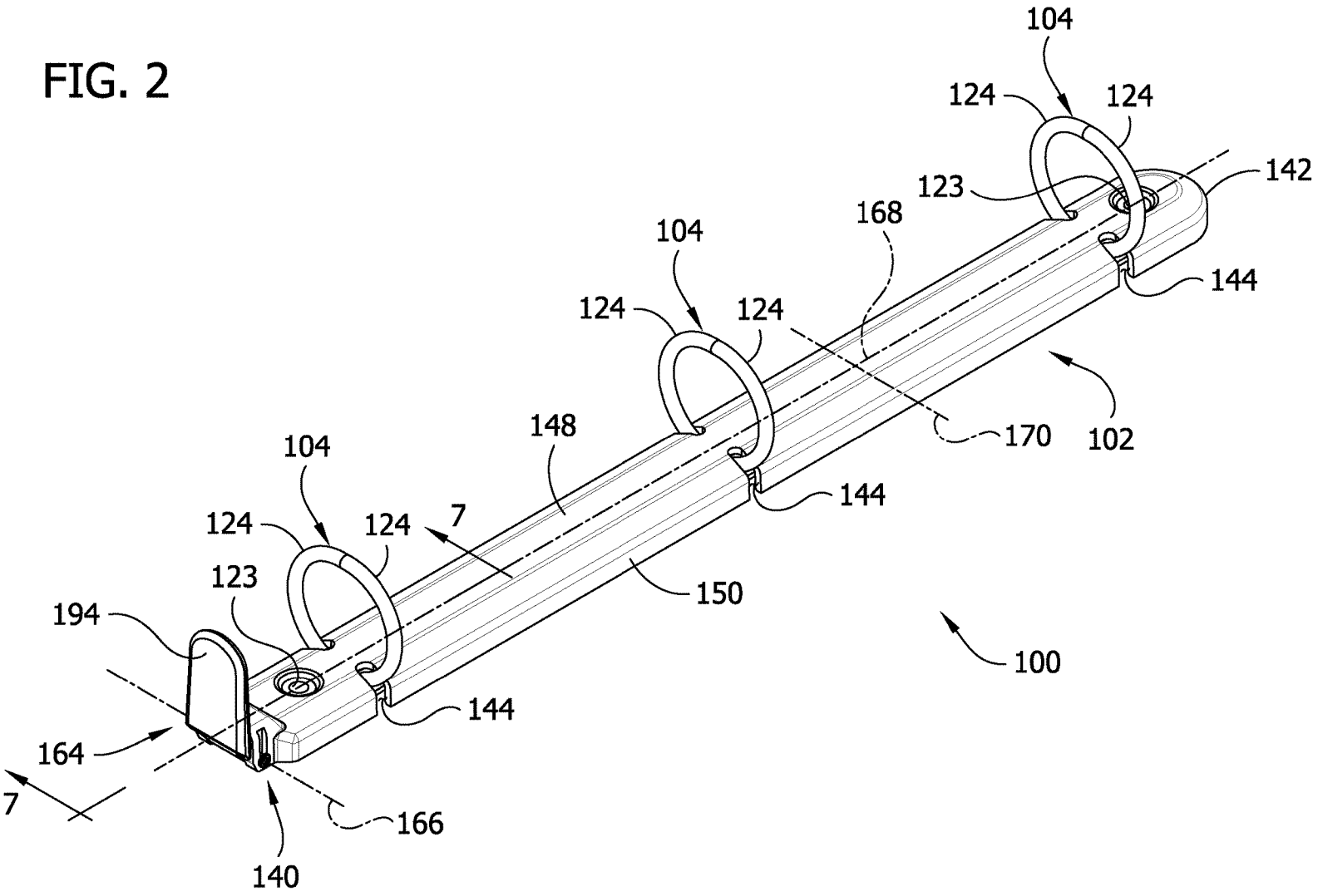
FIG. 2 is an enlarged perspective of the ring binder mechanism.
Figure 3:
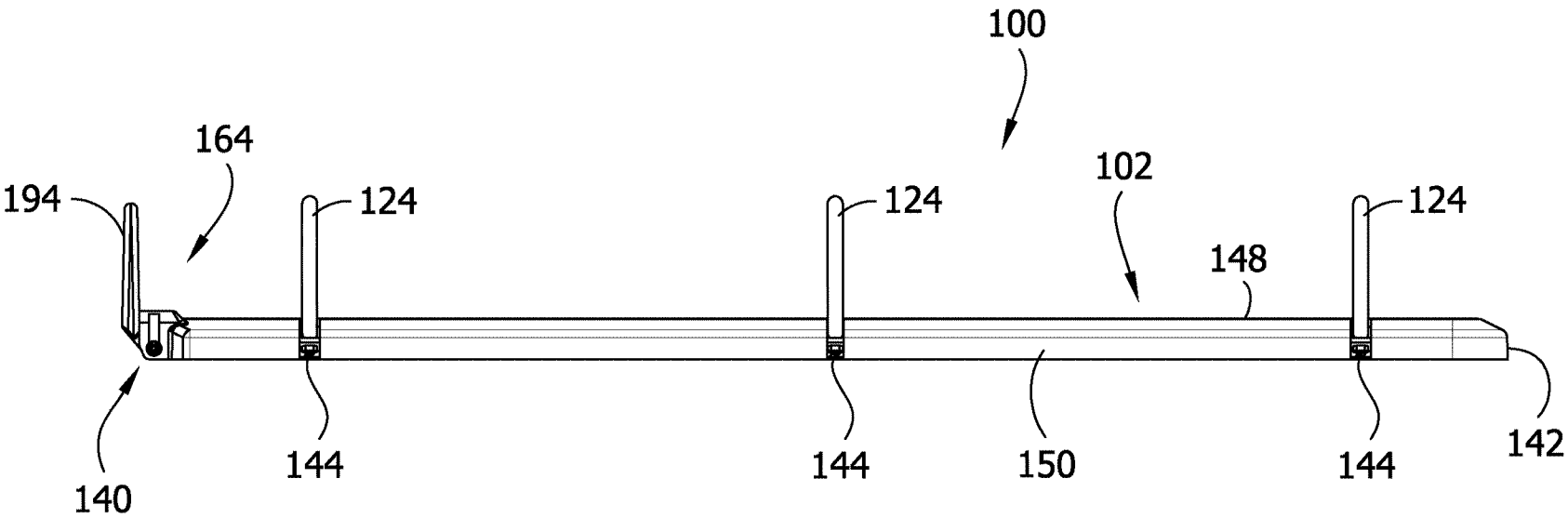
FIG. 3 is a side elevation of the ring binder mechanism.

Referring to the drawings, first to FIGS. 1-10 in particular, one embodiment of a ring binder mechanism is generally indicated at 100. This embodiment of the mechanism 100 includes a housing, designated generally at 102, supporting a pair of hinge plates 128 (broadly a ring support) and three rings, each of which is designated generally at 104. In FIG. 1, the mechanism 100 is shown mounted on a notebook designated generally at 10. Specifically, the mechanism 100 is shown mounted on the back cover 12 of the notebook 10 by means of rivets 113 generally adjacent to and aligned with the spine 14 of the notebook 10 securing the housing 102 to the notebook. The rivets 113 extend through attachment holes 123 at opposite ends of the housing 102. The front cover 16 of the notebook 10 is hingedly connected to the spine 14 and moves to selectively cover or expose loose-leaf pages (not shown) retained by the mechanism 100 in the notebook 10. Ring binder mechanisms mounted on notebooks in other ways (e.g., on the spine) or on surfaces other than a notebook (e.g., a file) do not depart from the scope of this invention. Ring binder mechanisms can also be in an unmounted state within the scope of the invention.

The housing 102 has an elongate shape comprising a central portion 148 and lateral sides 150 extending downward in generally vertical planes along either side of the central portion generally between opposite longitudinal ends 140, 142 spaced the length of the housing from one another. The arrangement of the central portion 148 and lateral sides 150 results in the housing having a generally concave cross-sectional configuration between the ends 140, 142. The housing 102 is constructed of a resilient polymeric material, such as Acrylonitrile butadiene styrene (ABS). For example, the housing can be made from materials and have characteristics described in co-pending U.S. application Ser. No. 11/852,006 and co-pending U.S. application Ser. No. 11/848,959, the contents of which are each hereby incorporated by reference. The entire housing 102 is molded as a single unitary piece as is the case for the embodiment illustrated in the drawings. However, the housing can include non-unitary features and can be manufactured in different ways, including by being constructed in multiple pieces that are later joined together to make the housing, without departing from the scope of the invention. The housing can also be made from non-polymeric (e.g., metallic) materials within the scope of the invention.

Figure 4:
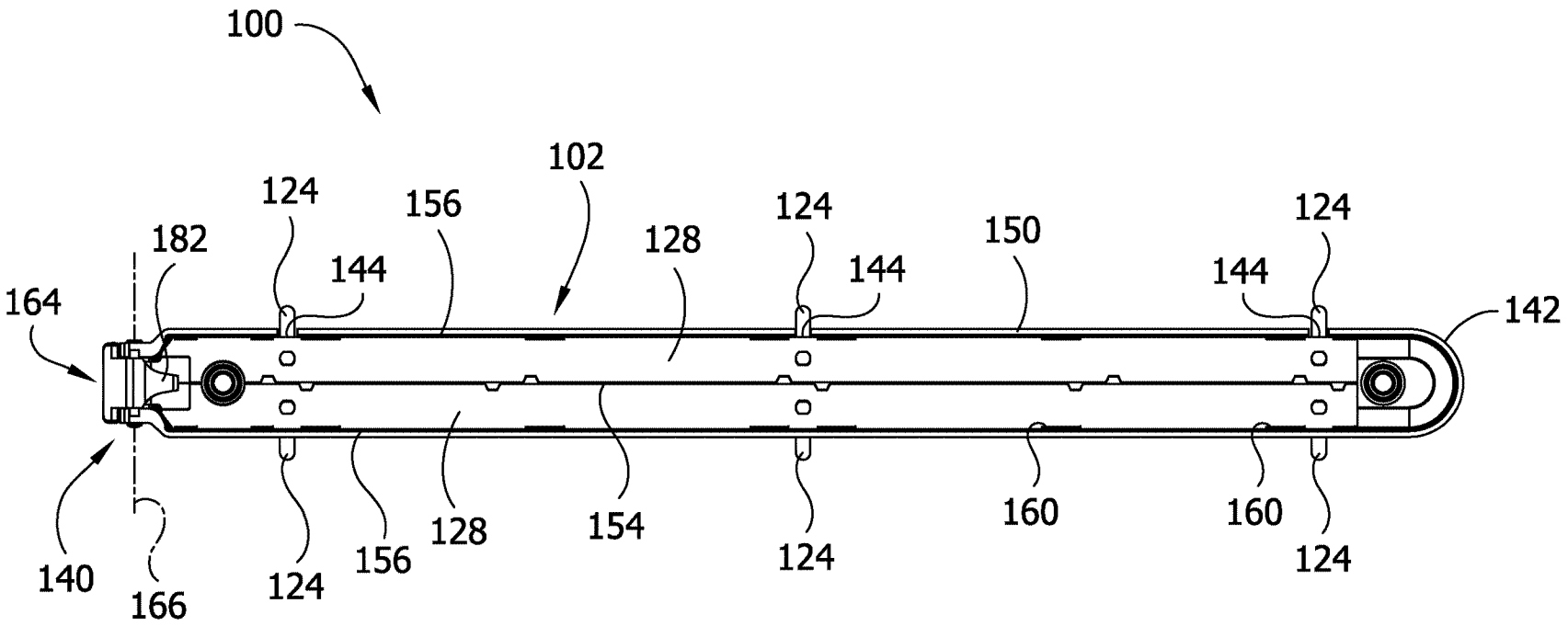
FIG. 4 is a bottom plan of the ring binder mechanism.
Figure 5:
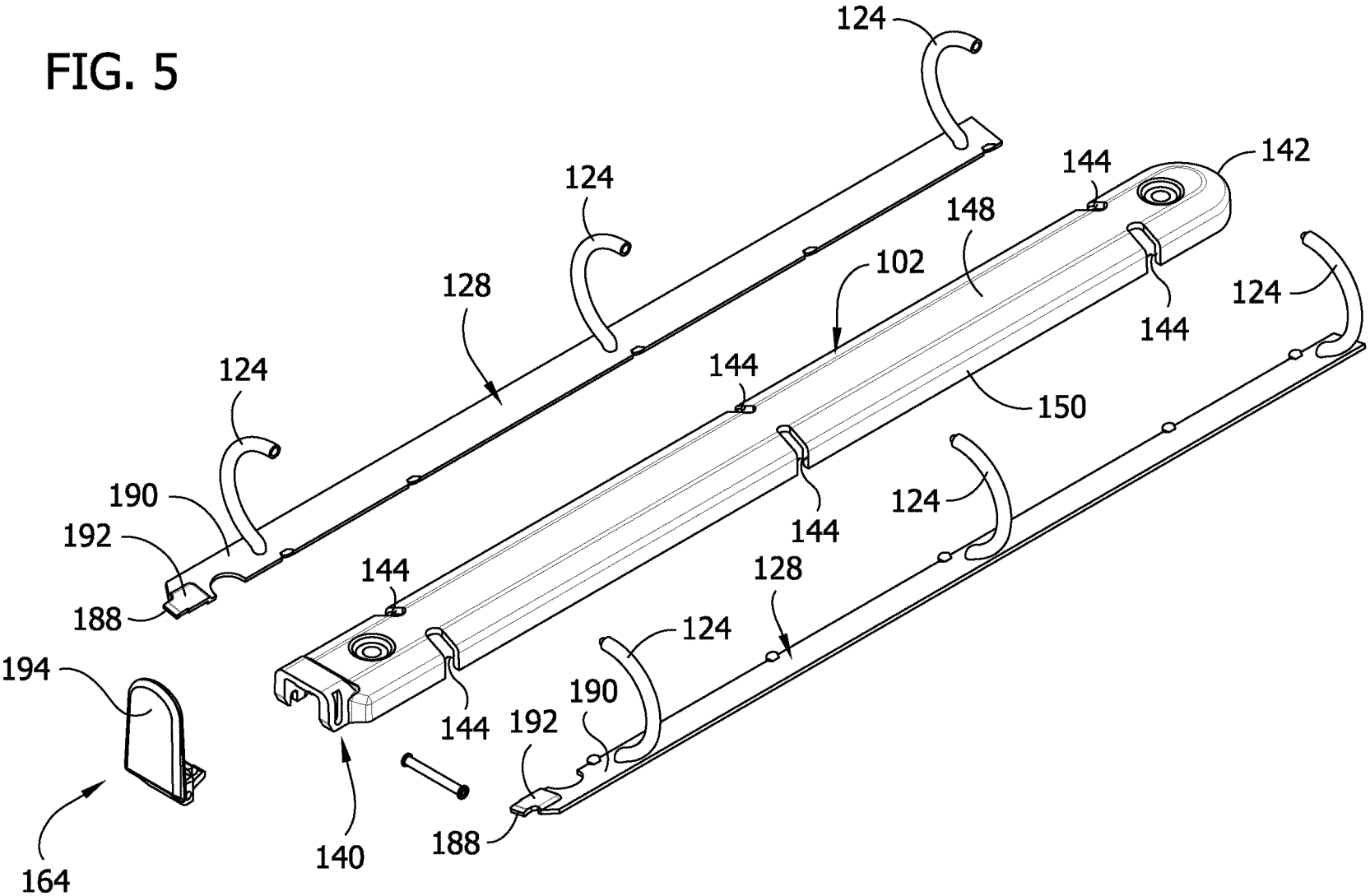
FIG. 5 is an exploded perspective of the ring binder mechanism.

The lateral sides 150 of the housing 102 in its undeformed state are spaced apart by a distance that is slightly less than the distance between the outer margins 156 of the interconnected hinge plates 128 when they are pivoted on the central hinge 154 to be coplanar with one another. The housing 102 is deformed from a fully relaxed or undeformed state even in the open and closed position so the housing continuously applies a spring force to the hinge plates 128 for holding them in the open and closed position, respectively. Other constructions for biasing the hinge plates 128 may be used within the scope of the present invention. The hinge plates 128 are supported by the housing 102 in a suitable manner such as by a plurality of hinge plate supports 160 projecting inwardly from the lateral sides 150 of the housing 102, as shown in FIG. 4. The hinge plate supports 160 are molded as one piece with the lateral sides 150 of the housing 102. The hinge plate supports 160 are engageable with the lateral edge margins 156 of the interconnected hinge plates 128 to retain the hinge plates in the housing 102 during operation of the ring binder mechanism 100.

The hinge plates 128 in this embodiment are generally mirror images of one another. The hinge plates 128 are each generally elongate, flat, and rectangular in shape, and are each somewhat shorter in length than the housing 102, as shown in FIG. 4. The hinge plates 128 are interconnected in side-by-side arrangement along their inner longitudinal margins, forming a central hinge 154 having a pivot axis for pivoting movement of the hinge plates relative to one another. This is may done in a conventional manner known in the art. The interconnected hinge plates 128 are disposed between the lateral sides 150 of the housing 102 such that the outer edge margins 156 of the hinge plates engage the lateral sides above the hinge plate supports 160, which retain the interconnected hinge plates 128 in the housing. As will be described, pivoting movement of the hinge plates 128 in the housing 102 is accompanied by movement of the central hinge 154 upward and downward relative to the housing as well as pivoting movement of outer edge margins 156 of the hinge plates relative to lateral sides 150 of the housing.

The rings 104 retain loose-leaf pages (not shown) on the ring binder mechanism 100 in the notebook 10. The three rings 104 of the ring binder mechanism 100 are substantially similar and are each generally circular in shape. The rings 104 each include two generally semi-circular ring members 124 formed from a conventional, cylindrical rod of a suitable material (e.g., steel). The ring members 124 include free ends 126 that are formed to secure the ring members against misalignment when they are closed together. The rings could be D-shaped as is known in the art, or shaped otherwise within the scope of this invention. Ring binder mechanisms with ring members formed of different material or having different cross-sectional shapes, for example, oval shapes, do not depart from the scope of this invention. Likewise the number of rings supported by the housing can vary within the scope of the invention.

One ring member 124 of each ring 104 is mounted on one of the interconnected hinge plates 128, while the other ring member of that ring is mounted on the opposite hinge plate. The ring members 124 extend through the openings 144 (e.g., slots, holes, or the like) in the housing 102 and are arranged so their free ends 126 face toward one another above the housing 102. The ring members 124 are moveable between an open position (FIG. 10) in which loose-leaf pages can be added to and/or removed from the ring binder mechanism 100 and a closed position (FIGS. 1 and 2) in which the free ends 126 of corresponding ring members 124 are joined to retain any loose-leaf pages then on the rings 104 in the binder mechanism.

In the illustrated embodiment, the ring members 124 are rigidly connected to the hinge plates 128 as is known in the art so the ring members move with the hinge plates when they pivot. Although in the illustrated ring binder mechanism 100 both ring members 124 of each ring 104 are each mounted on one of the two hinge plates 128 and move with the pivoting movement of the hinge plates 128, a mechanism in which each ring has one movable ring member and one fixed ring member does not depart from the scope of this invention (e.g., a mechanism in which only one of the ring members of each ring is mounted on a hinge plate with the other ring member mounted, for example, on the housing).

The ring binder mechanism 100 includes an actuator 164 operable to move the rings 104 from their closed position to their open position and from their open position back to their closed position. In this embodiment the actuator 164 is mounted at one end 140 of the housing 102 for pivotal movement of the actuator relative to the housing on a pivot axis 166. The pivot axis 166 is substantially perpendicular to a longitudinal axis 168 of the housing 102 and substantially parallel to a lateral axis 170 of the housing (e.g., an axis that is orthogonal to the longitudinal axis and oriented so it extends through each of the lateral sides 150 of the housing).

Figure 7:
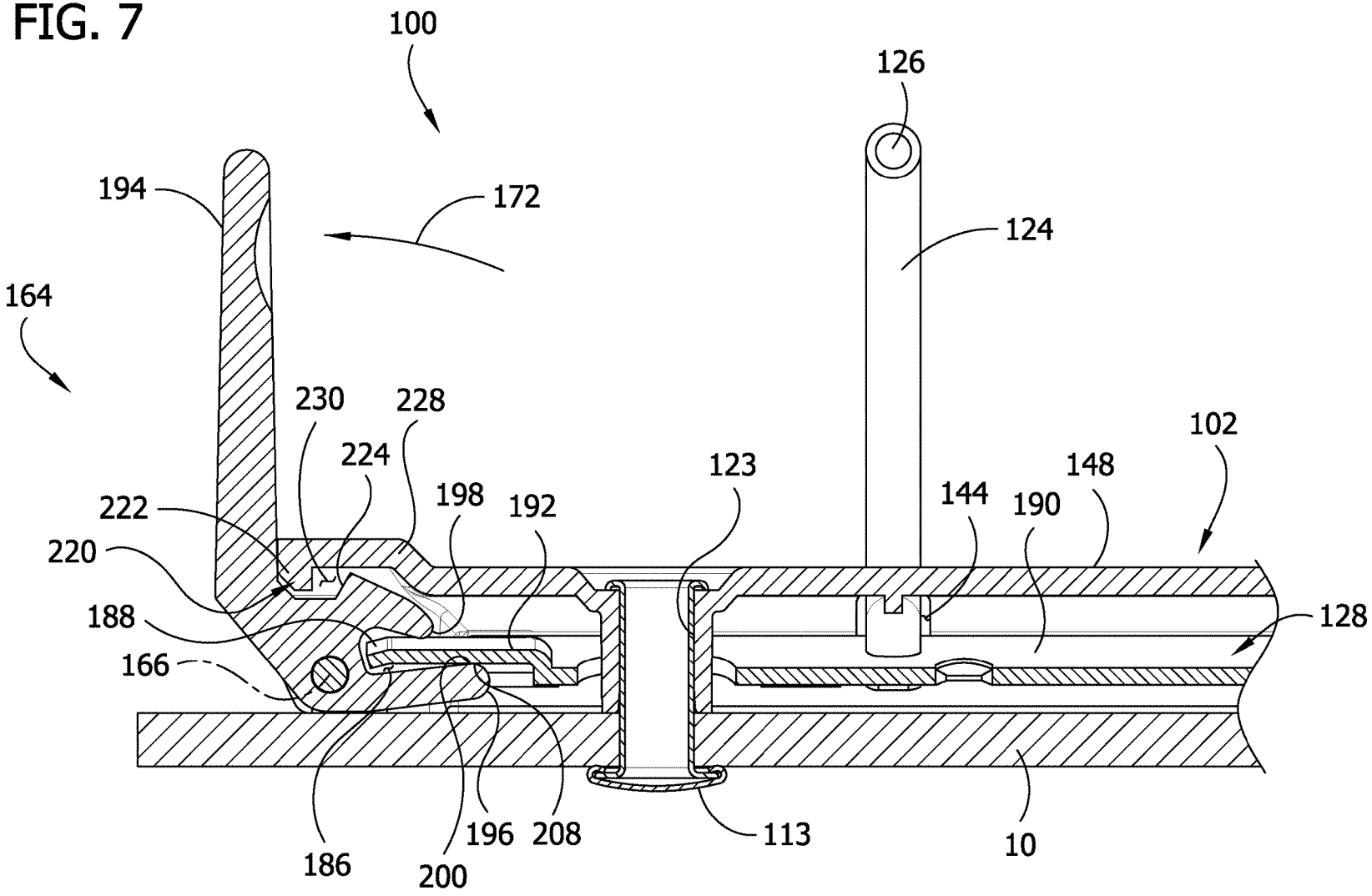
FIG. 7 is a fragmentary section of the ring binder mechanism taken in a plane including line 7-7 on FIG. 2.
Figure 7A:
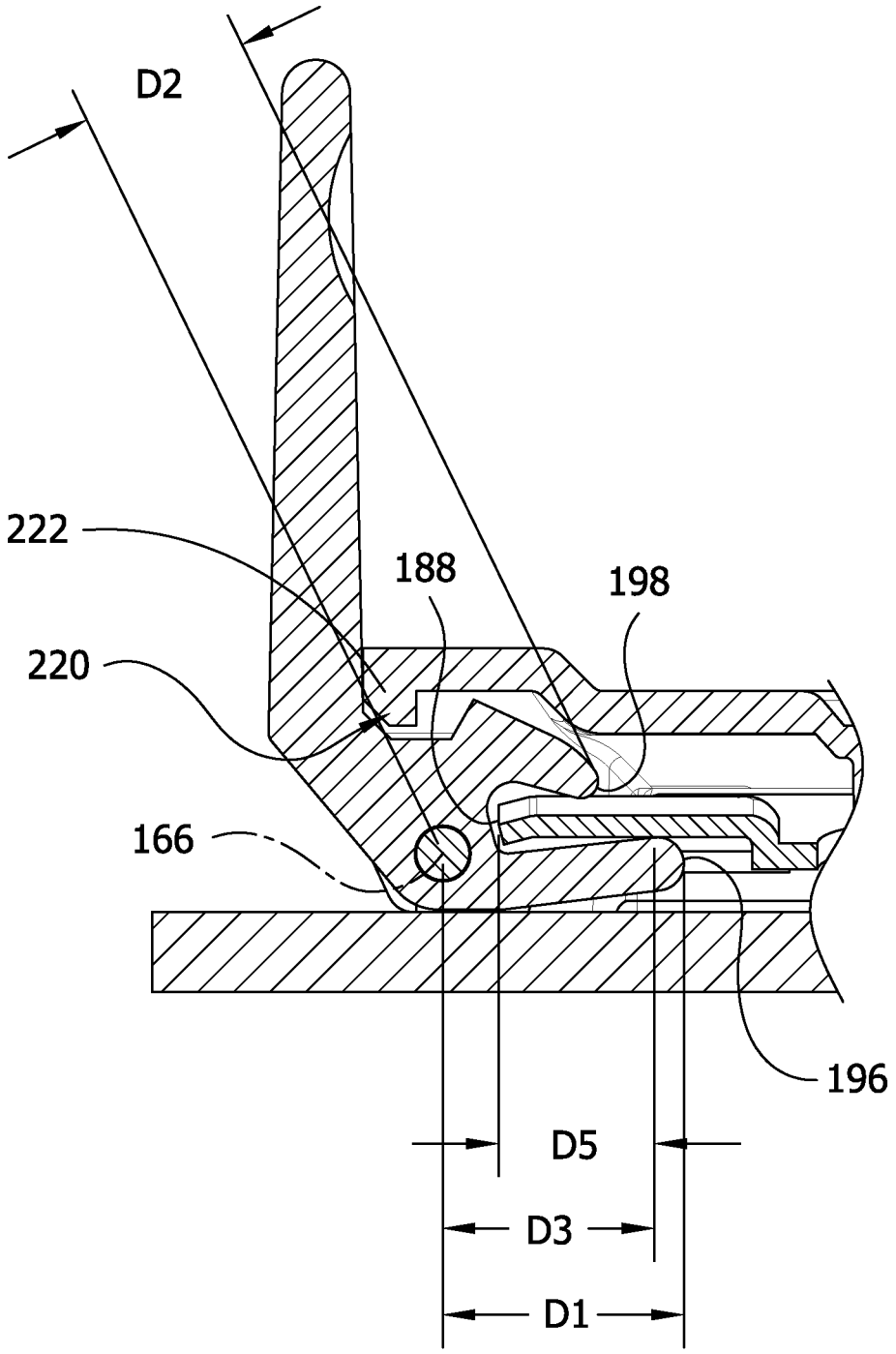
FIGS. 7A and 7B are the section of FIG. 7 but illustrating different spacings of components and surfaces of the ring binder mechanism.
Figure 7B:
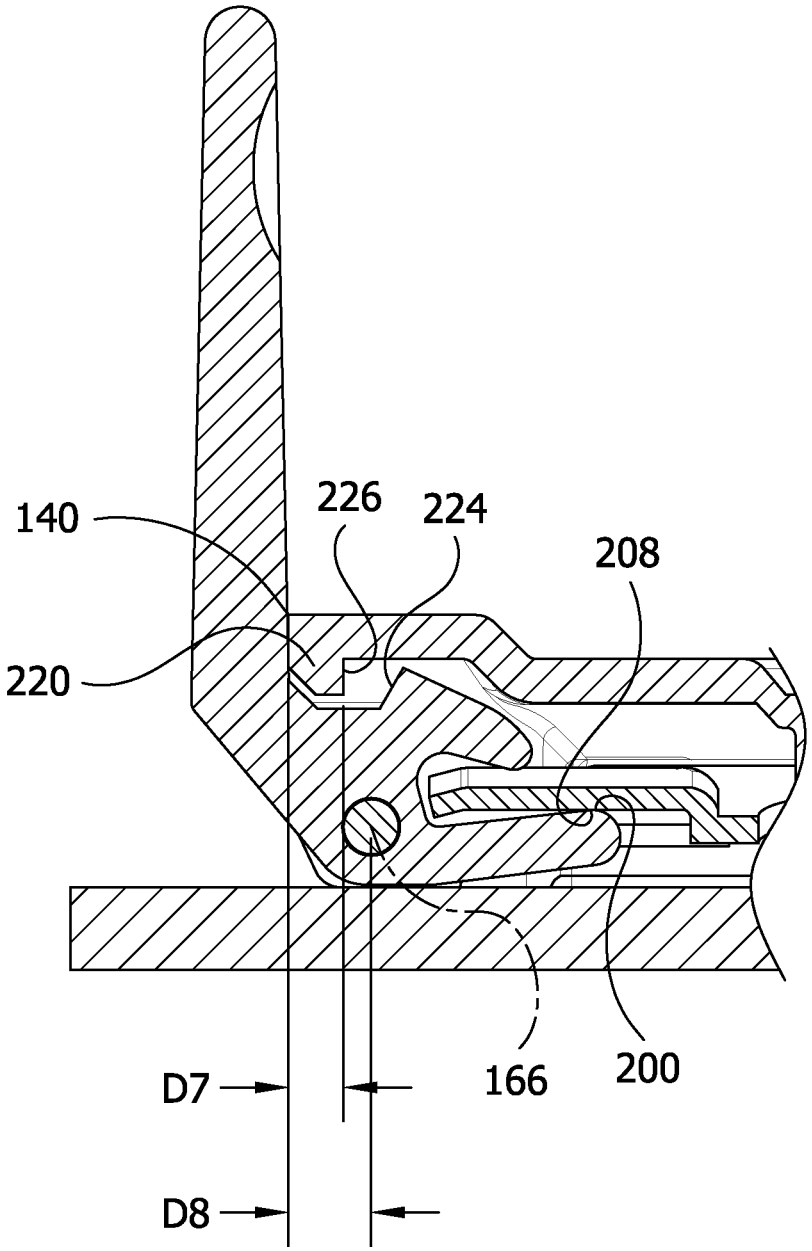

The actuator 164 is positioned and arranged so pivoting movement of the actuator on the pivot axis 166 in the direction of the arrow 172 shown on FIG. 7 when the rings 104 are closed causes the actuator to engage the hinge plates 128 and move the central hinge 154 upward in the housing 102, thereby pivoting the hinge plates and causing the rings to move from their closed position to their open position. In the embodiment shown in the drawings, the actuator 164 is also positioned and arranged so that pivoting movement of the actuator on the pivot axis in the reverse direction (indicated by the arrow 174 on FIG. 9) when the rings 104 are open causes the actuator to engage the hinge plates 128 and move the central hinge 154 downward in the housing 102, thereby pivoting the hinge plates and causing the rings to move from their open position to their closed position.

Referring to FIGS. 5-8, the actuator 164 in this embodiment of the ring mechanism has a yoke portion 180 including a lower arm 182 and an upper arm 184. The lower arm 182 of the yoke portion 180 extends from the pivot axis 166 between the lateral sides 150 of the housing 102 to a location adjacent the hinge plates 128 and on a side of the hinge plates opposite the central portion 148 of the housing for engaging the hinge plates during pivoting movement of the actuator to open the rings 104. The upper arm 184 of the yoke portion 180 extends from the pivot axis 166 between the lateral sides 150 of the housing 102 to a location adjacent the hinge plates 128 on a side of the hinge plates opposite the lower arm 182.

In this embodiment, the upper and lower arms 182, 184 together define a notch 186. The ends 188 of the hinge plates 128 are received in the notch 186. As illustrated in FIGS. 4 and 6-8, each of the hinge plates 128 in this embodiment includes a main body 190 and a finger 192 extending from the main body into the notch 186 and defining the end 188 of the respective hinge plate. The fingers 192 are narrower in width than the main body 190 of the hinge plates 128. Further, the end 188 of each of the fingers 192 is offset upward from the main body 190 of the respective hinge plate. This offset facilitates alignment of the ends 188 of the fingers 192 with the notch 186. The offset also facilitates lowering the elevation of the main bodies 190 of the hinge plates in the housing 102 so the central portion 148 of the housing can be spaced closer to the notebook 10 when it is secured thereto, allowing the housing to have a lower profile. However it is to be understood that the fingers 192 may be omitted without departing from the scope of the present invention. The actuator 164 also includes a lever arm 194 extending from the pivot axis 166 to a location exterior of the housing 102 for use in gripping and pivoting of the actuator by a user. The yoke portion 180 of the actuator 164 comprises a unitary body forming the upper and lower arms 182, 184. The unitary body also includes at least a portion of the lever arm 194, which may also include an elastomeric cover or grip portion (not shown) within the scope of the invention.

Figure 9:
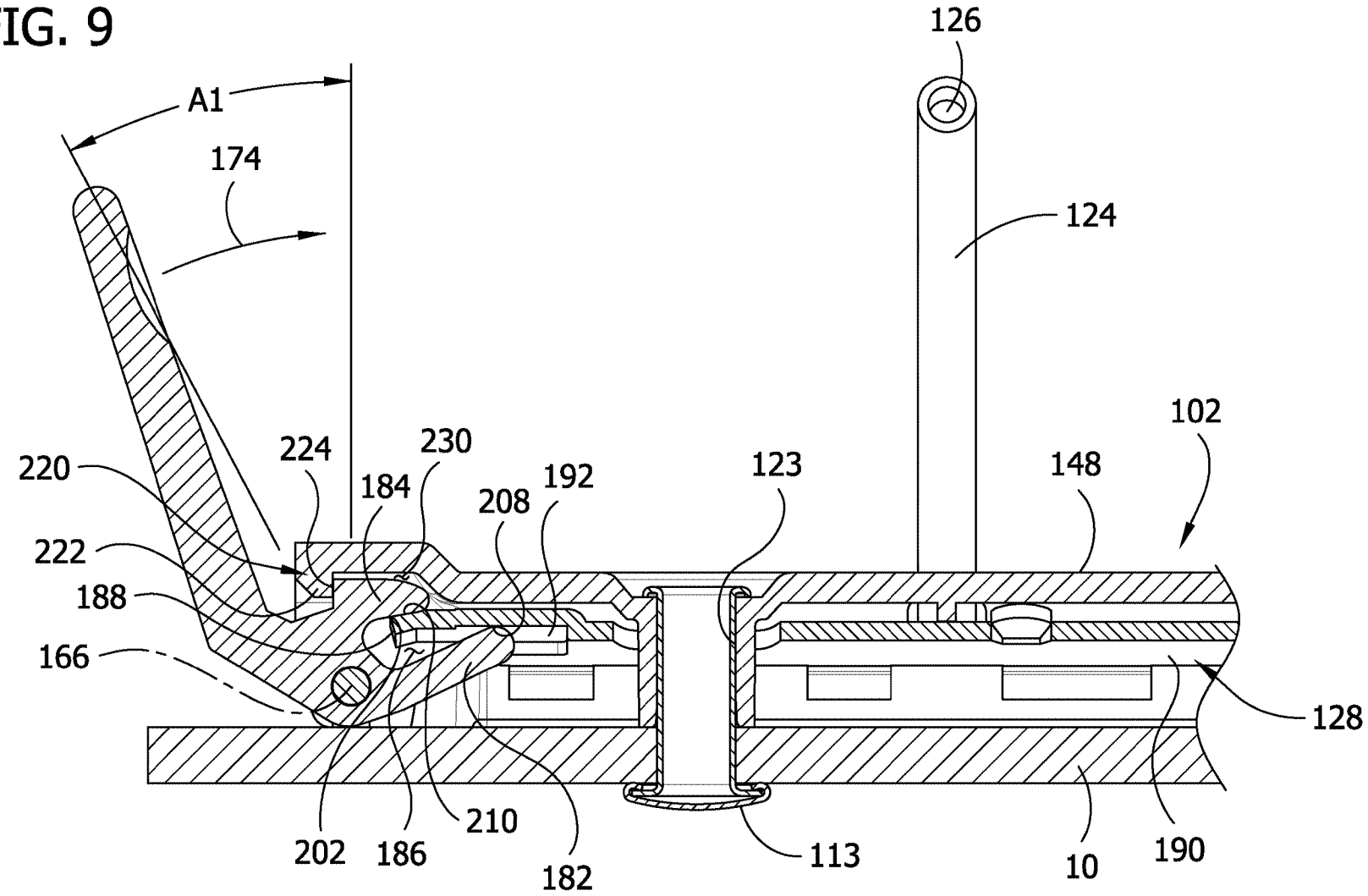
FIGS. 9 and 9A are fragmentary sections of the ring binder mechanism similar to FIGS. 7-7B showing the actuator in a terminal position after it has been used to open the rings of the ring binder.
Figure 9A:
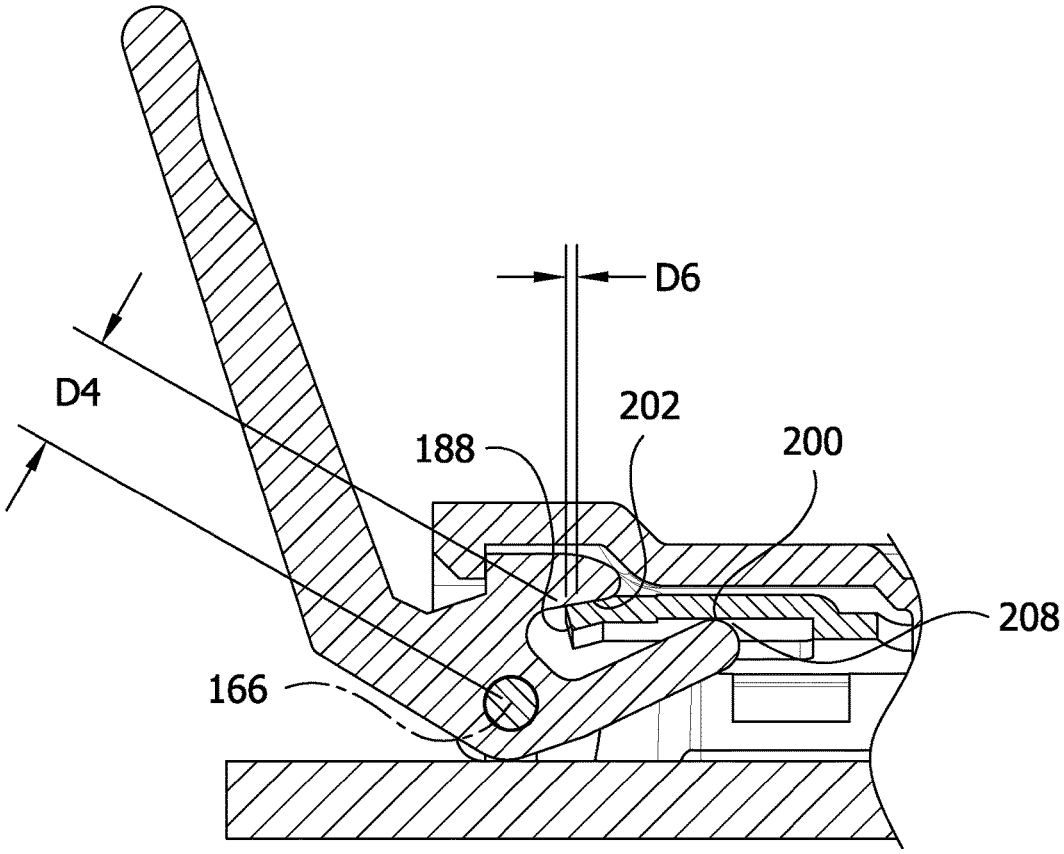
Figure 10:
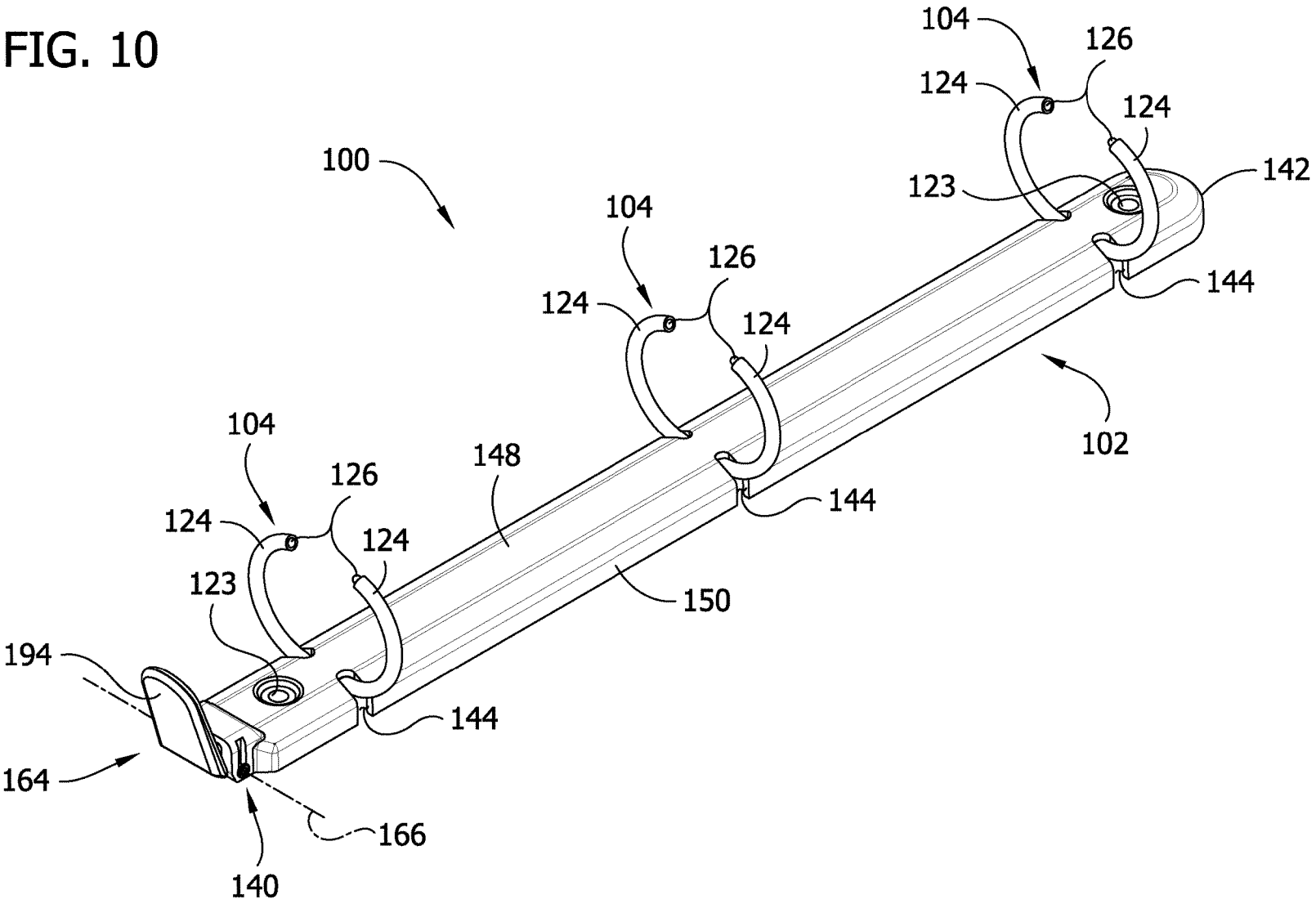
FIG. 10 is a perspective of the ring binder mechanism with the actuator in its terminal position and the rings in their open position.

The actuator 164 is positioned and arranged so that the actuator can open the rings 104 upon pivoting movement of the actuator through a relatively small angle A1 (FIG. 9). For example, in one embodiment the actuator 164 is operable to move the rings 104 from their closed position to their open position upon pivoting movement of the actuator through an angle A1 in the range of about 16 degrees to about 24 degrees. In another embodiment, the actuator 164 is operable to move the rings 104 from their closed position to their open position upon pivoting movement of the actuator through an angle A1 that is no more than about 24 degrees. Because the actuator 164 is operable to open the rings 104 upon pivoting movement through a relatively small angle A1, the actuator is more responsive to users' efforts to open the rings. This embodiment of the actuator 164 also reduces the amount of play in the actuator perceived by the user.

Figure 6:
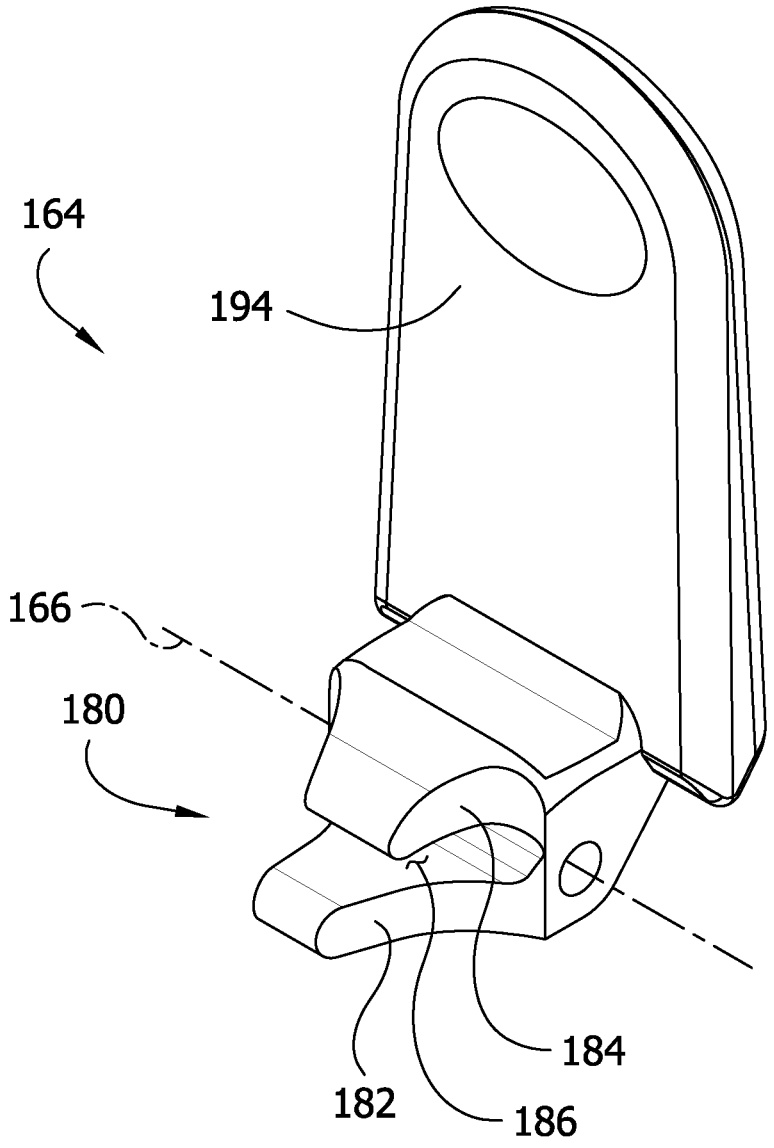
FIG. 6 is an enlarged perspective of an actuator of the ring binder mechanism.
Figure 8:
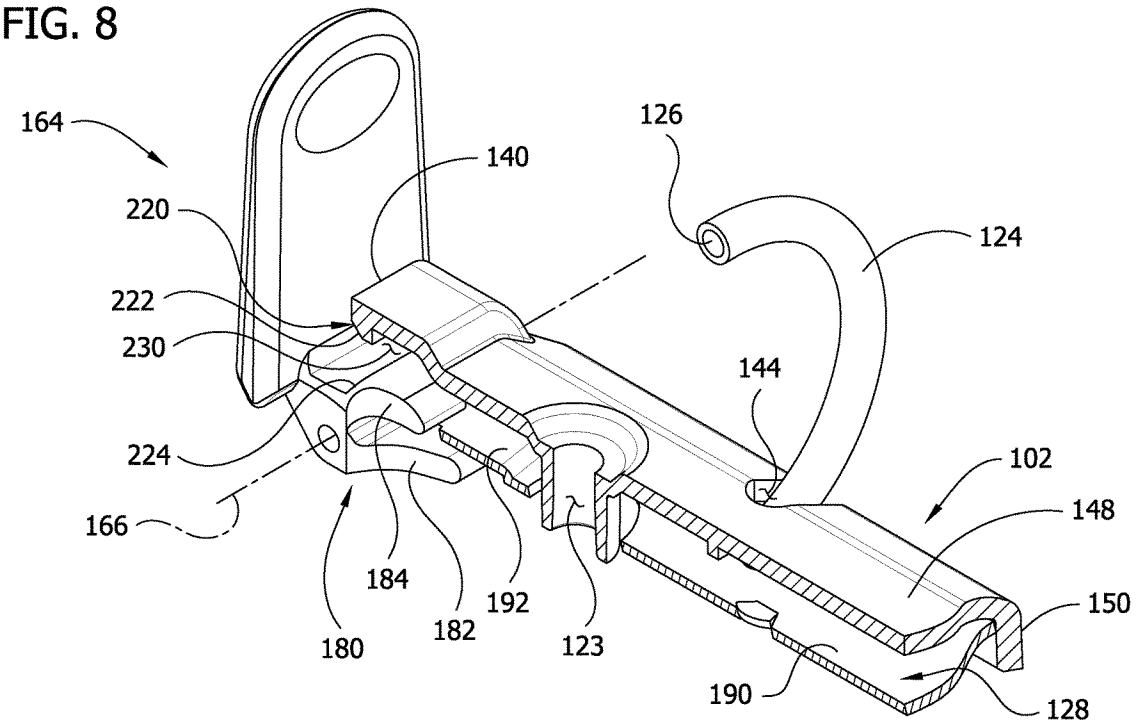
FIG. 8 is a perspective of a portion of the ring binder mechanism with the housing and one hinge plate being partially broken away and one hinge plate removed.

In the illustrated embodiment, the lower arm 182 of the actuator 164 is relatively long (in comparison to the upper arm 184), which facilitates opening of the rings 104 upon movement of the actuator through the relatively smaller angle A1. As illustrated in FIGS. 6-8, for example, the distal end 196 of the lower arm 182 of the illustrated embodiment is spaced a relatively longer distance D1 from the pivot axis 166 and the distal end 198 of the upper arm 184 is spaced a relatively shorter distance D2 from the pivot axis. In one embodiment of the invention, the distal end 196 of the lower arm 182 is spaced from the pivot axis 166 a distance D1 of at least about 6.5 mm. In another embodiment, the distal end 196 of the lower arm 182 is spaced from the pivot axis 166 a distance D1 in the range of about 6.5 mm to about 10.5 mm.

As illustrated in FIGS. 7-7B and 9-9A, the lower arm 182 has a contact surface 200 that contacts the lower surfaces of hinge plates 128 during pivoting movement of the actuator 164 to open the rings 104. Likewise, in the illustrated embodiment, the upper arm 184 has a contact surface 202 that contacts the upper surfaces of the hinge plates 128 during pivoting movement of the actuator 164 to close the rings. It will appreciated that different parts of the arms 182, 184 of the actuator 164 will contact that hinge plates 128 at various intermediate positions of the actuator and hinge plates between the open and closed position. As used herein, the phrase "contact surface" used in reference to interactions between the actuator 164 and hinge plates 128 includes all parts of one of the actuator and hinge plates that contact the respective other of the hinge plates and actuator anytime during pivoting movement of the actuator to open or close the rings 104.

In one embodiment of the invention, the nearest edge of the contact surface 200 on the lower arm 182 is spaced distance D3 from the pivot axis 166 and the nearest edge of the contact surface 202 on the upper arm 184 is spaced a distance D4 from the pivot axis that is shorter than D3. In one embodiment, for example, the distance D3 between the contact surface 200 on the lower arm 182 and the pivot axis 166 is at least about 6 mm. In another embodiment, the distance D3 between the contact surface 200 on the lower arm 182 and the pivot axis is between about 6 mm and about 9 mm. The fingers 192 of the hinge plates 128 have contact surfaces 208, 210 on their lower and upper surfaces that contact the upper and lower arms 182, 184 of the actuator, respectively. In one embodiment of the invention, the nearest edge of the contact surface 208 on lower side of the hinge plates 128 is spaced from the ends 188 of the hinge plates a distance D5 and the nearest edge of the contact surface 210 on the upper side of the hinge plates is spaced a distance D6 from the ends 188 of the hinge plates that is shorter than D5. For example, the distance D5 in one embodiment is at least about 0.5 mm longer than the distance D6. In another embodiment, the distance D5 is longer than the distance D6 by an amount in the range of about 0.5 mm to about 1.0 mm. In one embodiment, the distance D5 may range from about 4 mm to about 7 mm. In another embodiment the distance D6 may range from about 3.3 mm to about 6.3 mm. However, other distances may be used within the scope of the invention, and in particular the distance D6 may be zero.

The housing 102 is configured to define a stop 220 that limits pivoting movement of the actuator 164 after the rings 104 have been opened. As illustrated in FIGS. 6 and 6A, for example, the stop 220 of the illustrated embodiment includes a projection 222 (e.g., barb) extending down from the central portion 148 of the housing 102. The stop 220 is integrally formed (e.g., molded) with the rest of the housing 102. However, the stop 220 can be made separate from the other parts of the housing and later secured to the housing within the scope of the invention. As illustrated in FIG. 7, the stop 220 has an engagement surface 226 spaced a distance D7 from the adjacent end 140 of the housing 102 that is less than a distance D8 between the pivot axis 166 and the adjacent end of the housing. The stop 220 is positioned and arranged relative to the actuator 164 so that a surface 224 of the actuator (e.g., a surface on the upper arm 184) engages the stop after the actuator has pivoted relative to the housing 102 in the direction of the arrow 172 that causes the rings 104 to open to a terminal position (FIG. 9). The surface 224 projects out from the actuator 164 so that it is able to engage the general vertical surface of the stop 220 generally flush in the open position. Further, the engagement between the actuator 164 and the stop 220 limits pivoting movement of the actuator relative to the housing 102 in the direction 172 that opens the rings 104 beyond the terminal position.

In the illustrated embodiment, a raised portion 228 of the housing 102 defines a recess 230 at one end 140 in the central portion 148 thereof adjacent the stop 220. The recess 230 provides clearance for the upper arm 184 as the actuator 164 approaches the terminal position during pivoting of the actuator during opening of the rings 104. The presence of the recess 230 at the end 140 of the housing 102 provides the clearance required for pivoting movement of the actuator 164 without increasing the overall profile of the housing. Further, the presence of the recess 230 adjacent the stop 220 allows the stop to have a larger contact surface 226 for engaging the actuator.

When the mechanism 100 is at rest, the ring members 124 and hinge plates 128 are normally at their closed position. When a user wants to open the rings 104, he or she can grasp the lever arm 194 and use it to pivot the actuator 164 in the direction 172 shown in FIG. 7. This causes the contact surface 200 on the lower arm 182 of the yoke portion 180 of the actuator 164 to engage the contact surface 208 on the lower side of the hinge plates 128. As the user continues to pivot the actuator 164 in this direction 172, the lower arm 182 pushes the central hinge 154 of the hinge plates 128 upward in the housing 102, thereby causing the hinge plates to pivot relative to one another and the housing. The ring members 124 pivot with the hinge plates 128, thereby moving from their closed position to their open position. In one embodiment, the opening movement of the rings 104 is completed upon pivoting movement of the actuator 164 through a relative small angle A1 (e.g., an angle in the range of about 16 to about 24 degrees). In another embodiment, the opening movement of the rings 104 is completed upon pivoting movement of the actuator 164 through an angle A1 (FIG. 9) of no more than about 24 degrees.

As the actuator 164 is pivoted to open the rings 104, the yoke portion 180 (and in particular the upper arm 184 of the yoke portion) is received in the recess 230 defined in the central portion 148 of the housing 102. As the pivoting movement of the actuator 164 that is required to open the rings 104 nears completion, the yoke portion 180 of the actuator (and in particular the upper arm 184) approaches the stop 220. The actuator 164 engages the stop 220 when it arrives at its terminal position. It is possible for a user to perceive engagement of the actuator 164 with the stop 220 as a tactile sensation providing feedback indicating that further movement of the actuator is not required to open the rings 104. Moreover, the stop 220 limits further pivoting movement of the actuator 164 in the opening direction 172 beyond the terminal position, thereby facilitating the retaining of the actuator on the housing 102.

When the user wants to close the rings 104, he or she can grasp the lever arm 194 and use it to pivot the actuator 164 in direction of the arrow 174 (FIG. 9). This causes the contact surface 202 on the upper arm 184 of the actuator 164 to engage the contact surface 210 on the upper side of the hinge plates 128. As the user continues to pivot the actuator 164 in the direction of the arrow 174, the upper arm 184 pushes the central hinge 154 of the hinge plates 128 down in the housing 102, causing the hinge plates to pivot relative to one another and the housing. The ring members 124 pivot with the hinge plates 128 to their closed position.

Figure 11:
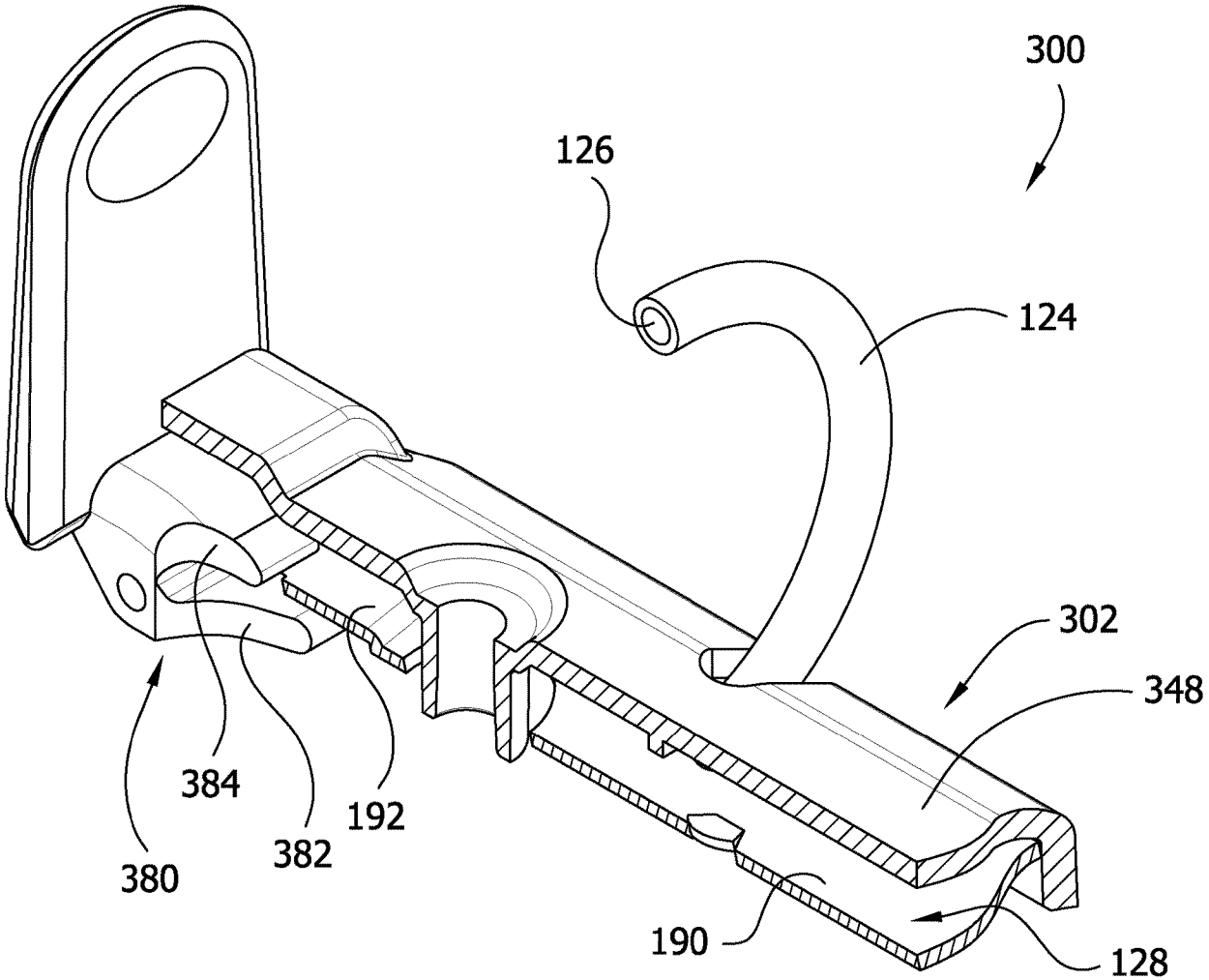
FIG. 11 is a perspective similar to FIG. 8 showing a second embodiment of a ring binder mechanism.
Figure 12:
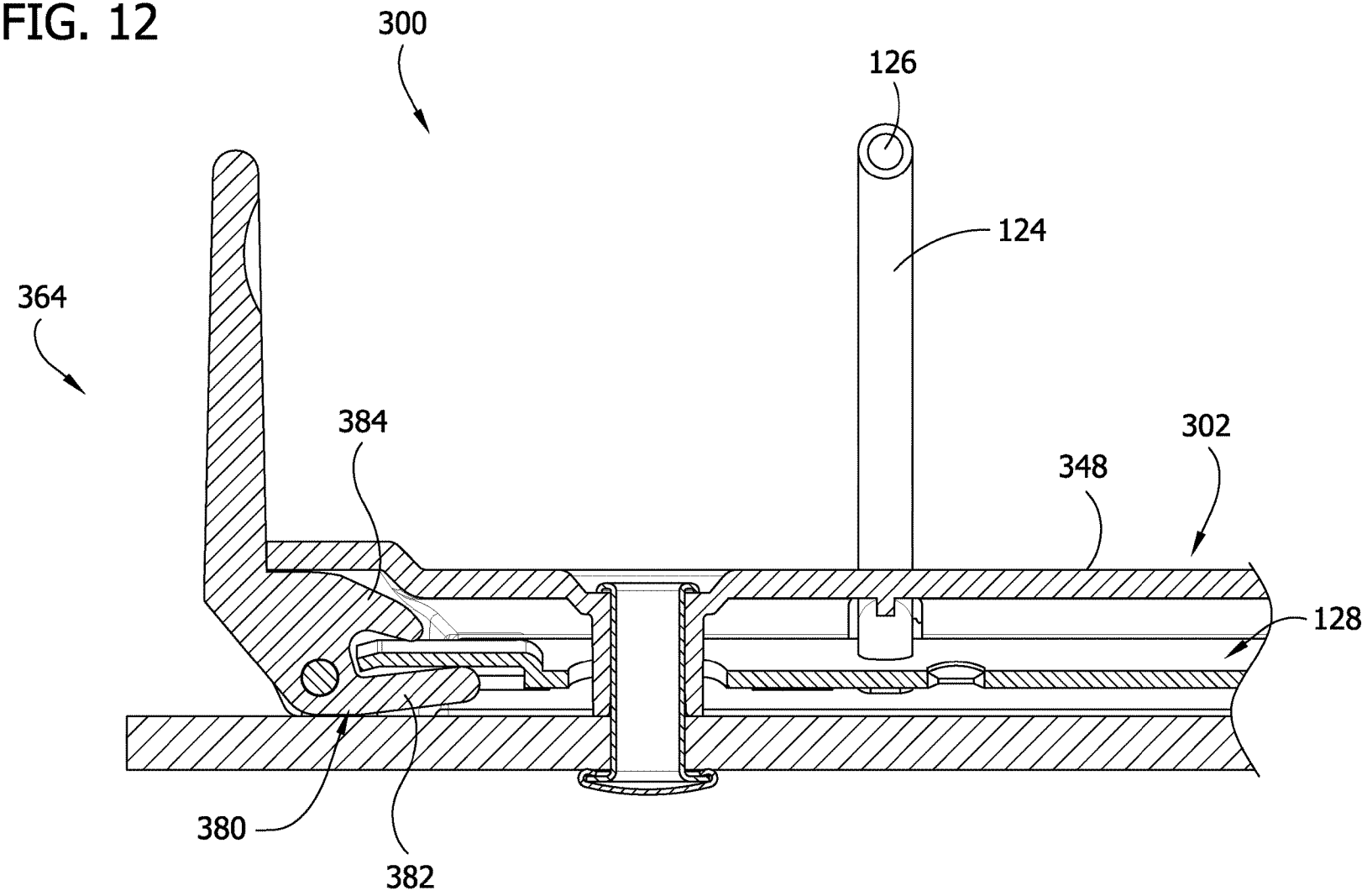
FIG. 12 is a fragmentary section similar to FIG. 7 but illustrating the second embodiment.
Figure 13:
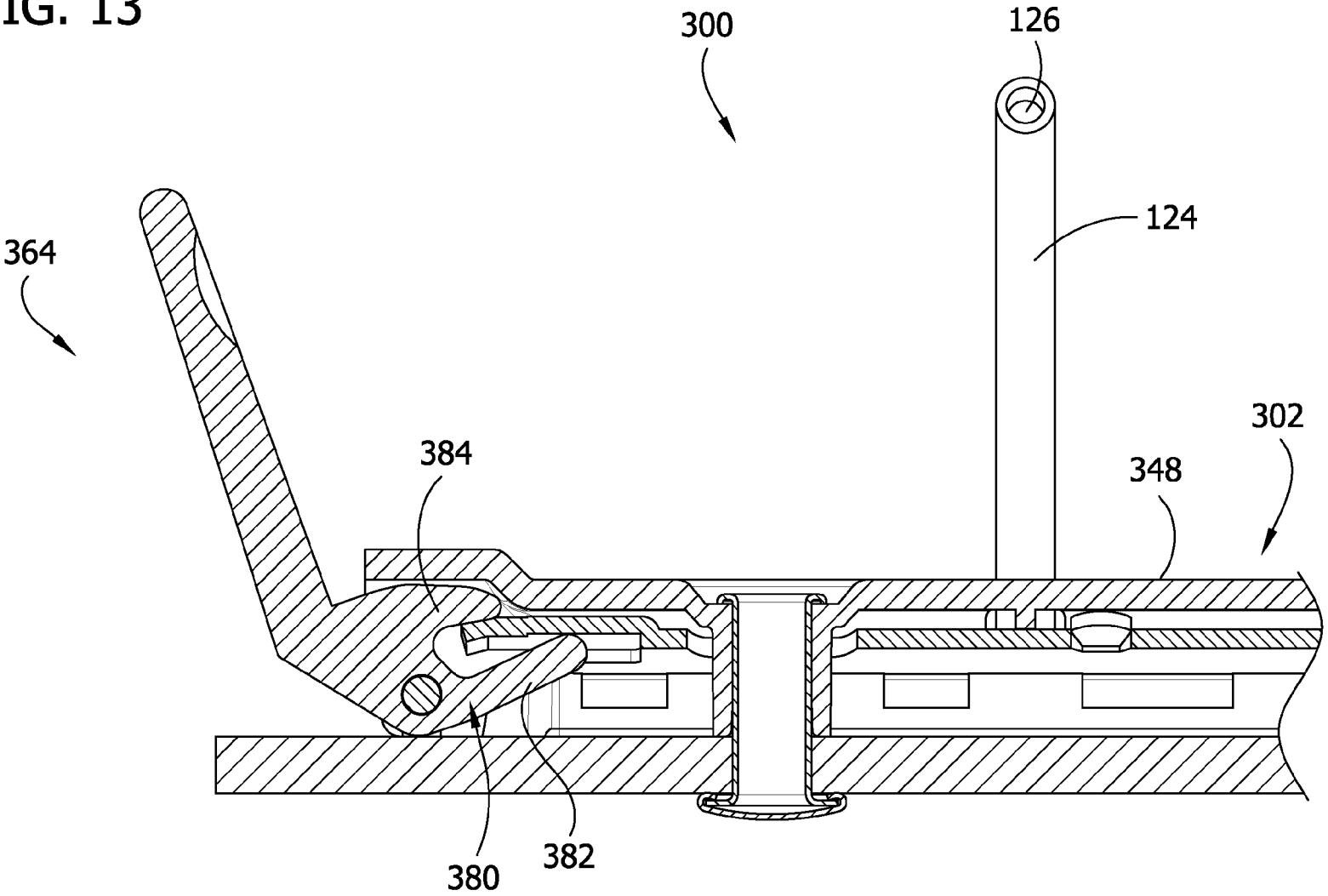
FIG. 13 is a fragmentary section similar to FIG. 9 but showing the second embodiment with the actuator in its terminal position after it has been used to open the rings.

FIGS. 11-13 illustrate a second embodiment of a ring binder mechanism of the present invention, generally designated 300. Except as noted this embodiment of the ring binder mechanism 300 is constructed and operated in substantially the same way as the ring binder mechanism 100 described above. As best illustrated in FIG. 12, the housing 302 in this embodiment does not define a stop. Further, the upper arm 384 of the yoke portion 380 lacks a surface adapted to engage a stop. On the other hand, the lower arm 382 of the yoke portion 380 of the actuator 364 is relatively longer, as described above. Further, the actuator 364 and hinge plates 128 have contact surfaces 200, 202, 208, 210 that are spaced and arranged as described above. Moreover, the actuator 364 is operable to open the rings 104 upon movement of the actuator through the relatively small angle A1 (e.g., in the range of about 16 to about 24 degrees) as described above. After the user has pivoted the actuator 364 to its terminal position (FIG. 13), further pivoting movement of the actuator 364 in the opening direction is prevented by engagement of the actuator and/or hinge plates 128 with the housing 102 (e.g., the central portion 148 thereof).

Figure 14:
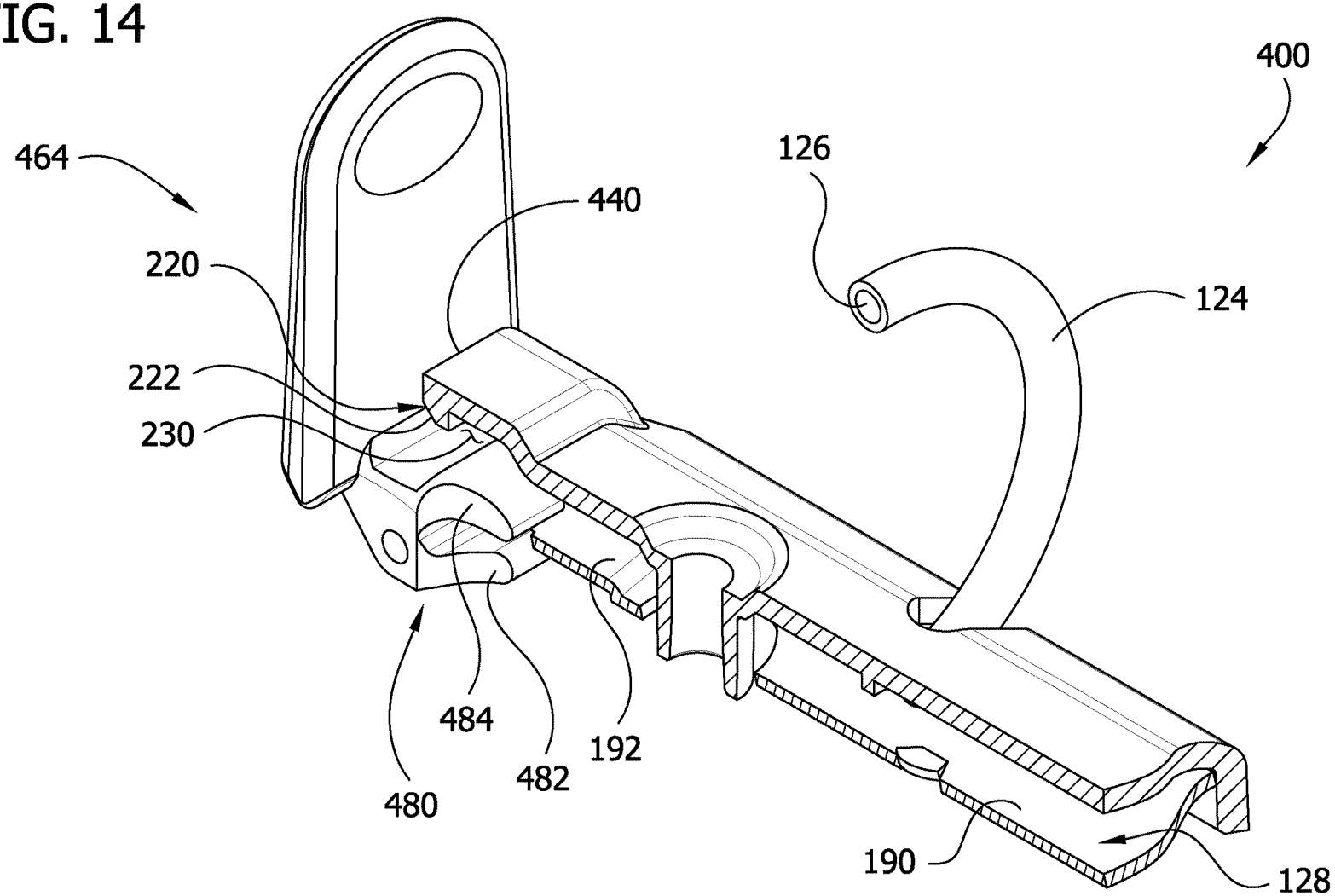
FIG. 14 is a perspective similar to FIGS. 8 and 11 but illustrating a third embodiment.
Figure 15:
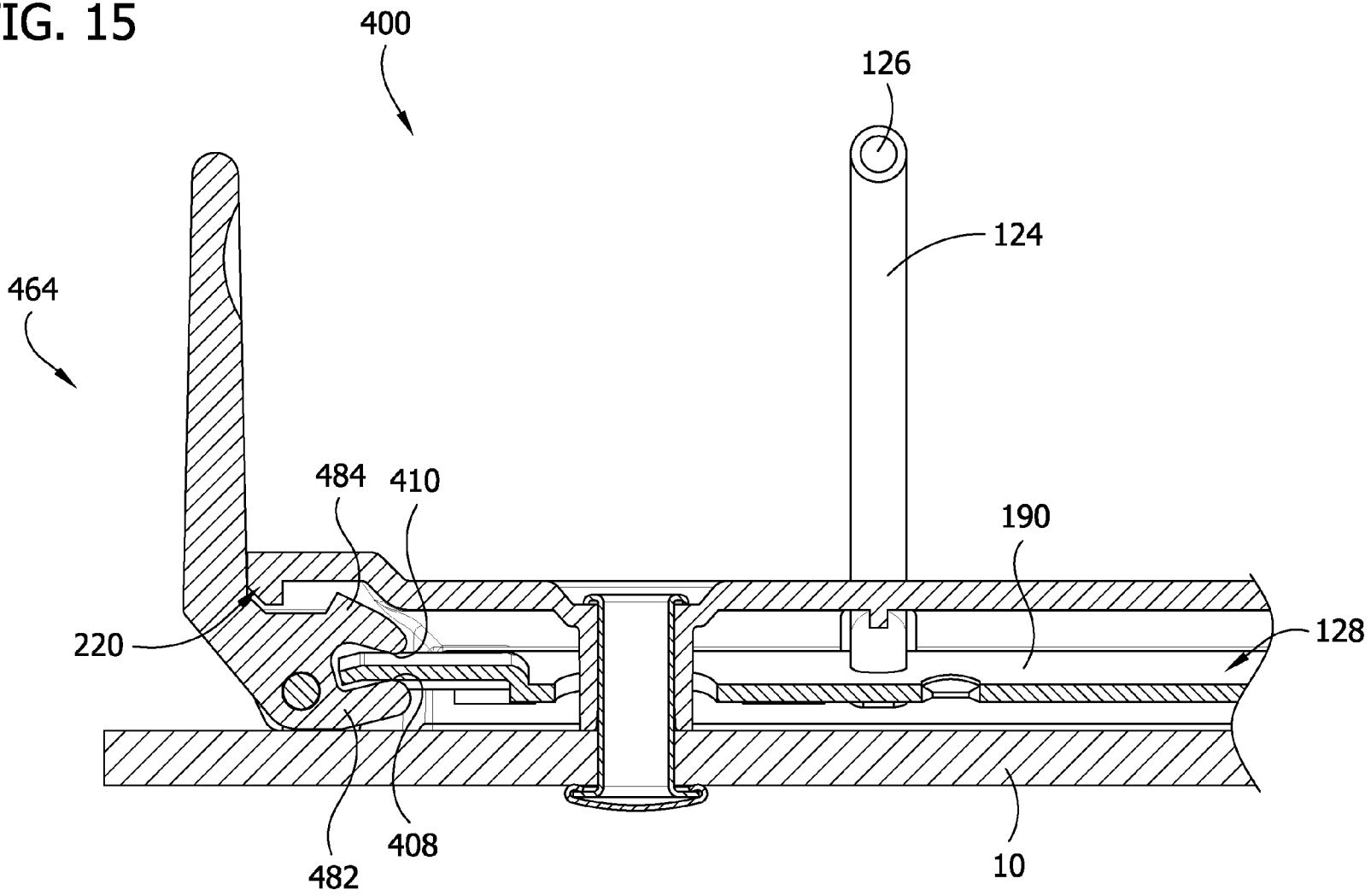
FIG. 15 is a fragmentary section similar to FIGS. 9 and 12 but showing the third embodiment.
Figure 16:
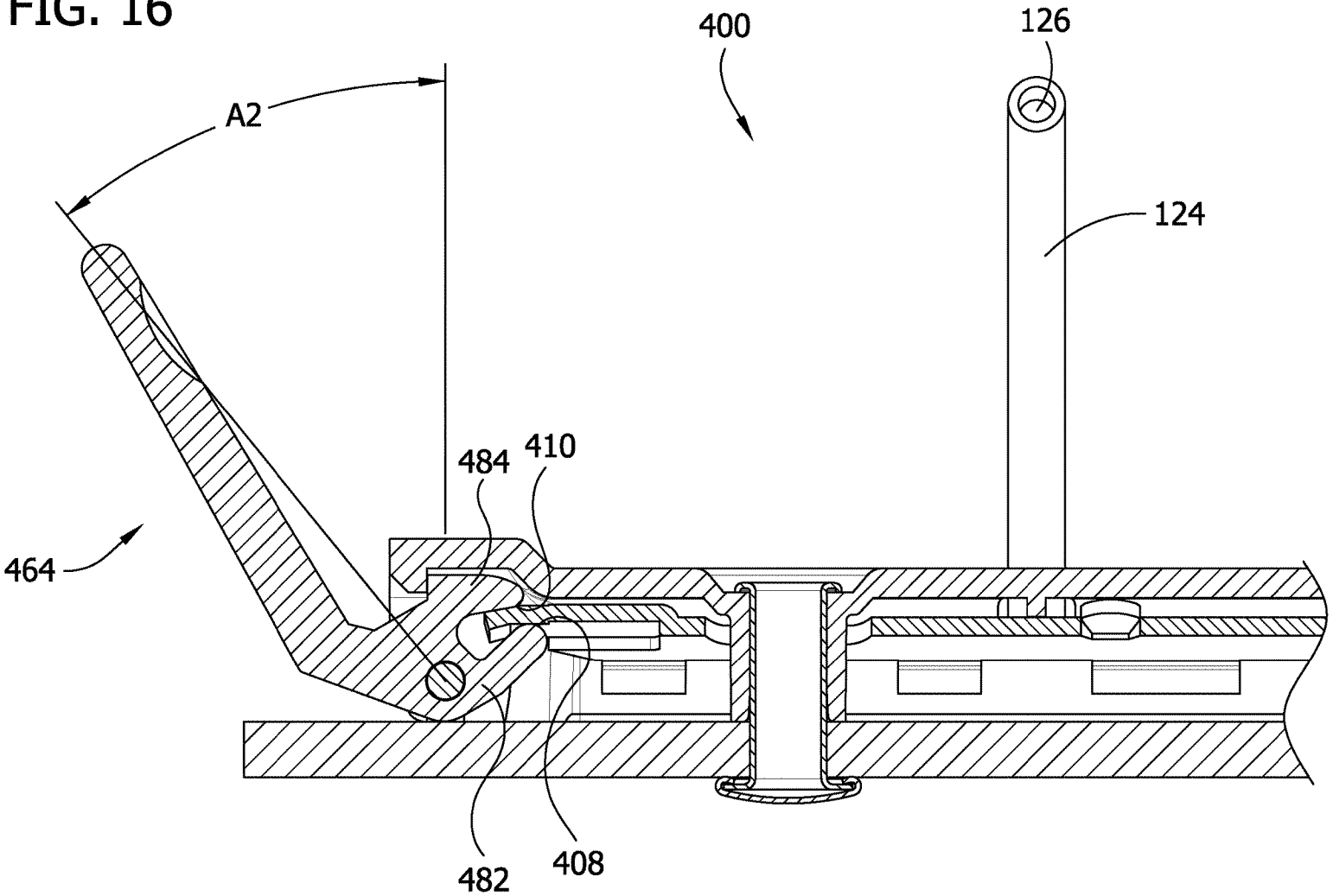
FIG. 16 is a cross section of the third embodiment similar to FIGS. 10 and 13 showing the actuator in its terminal position after it has been used to open the rings.

FIGS. 14-16 illustrate a third embodiment of a ring binder mechanism of the present invention, generally designated 400. Except as noted, this embodiment of the ring binder mechanism 400 is constructed and operated in substantially the same way as the ring binder mechanism 100 described above. As best illustrated in FIG. 15, the lower arm 482 of the actuator 464 of this embodiment is not substantially longer than the upper arm 484. Instead the contact surface 410 of the hinge plates 128 with the upper arm 484 and the contact surface 408 of the hinge plates with the lower arm 482 are either in registration with one another on opposite sides of the hinge plates or nearly in registration with one another. The actuator 464 in this embodiment is operable to complete opening movement of the rings upon pivoting movement of the actuator through a relatively larger angle A2. In one embodiment, the actuator 464 is operable to complete opening movement of the rings 104 upon pivoting movement of the actuator through an angle A2 of at least about 26 degrees. In another embodiment, the actuator 464 is operable to complete opening movement of the rings 104 upon pivoting movement of the actuator through an angle A2 in the range of about 26 degrees to about 35 degrees. In this embodiment, the housing 102 does define a stop 220 that is engaged by the actuator 464 upon arrival of the actuator at its terminal position (FIG. 16) in substantially the same way described above, except that the actuator is rotated through the larger angle A2 to move from its initial position (FIG. 14) to its terminal position than the actuator 164 described above.

When introducing elements of the present invention or the preferred embodiments thereof, the articles "a", "an", "the" and "said" are intended to mean that there are one or more of the elements. The terms "comprising", "including," and "having" are intended to be inclusive and mean that there may be additional elements other than those listed.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A ring binder mechanism for holding loose-leaf pages, the mechanism comprising:

an elongate housing having a central portion and lateral sides extending downwardly along either side of the central portion;

a ring support comprising a pair of hinge plates in generally side-by-side relation and hingedly connected to one another for pivoting movement relative to each other, the hinge plates being held between the lateral sides of the housing;

a plurality of rings for holding the loose-leaf pages, each ring including a first ring member and a second ring member, the first ring member being mounted on the ring support for movement with the ring support relative to the housing between a closed position and an open position, in the closed position the first and second ring members forming a substantially continuous, closed loop for allowing loose-leaf pages retained by the rings to be moved along the rings from one ring member to the other, and in the open position the first and second ring members forming a discontinuous, open loop for adding or removing loose-leaf pages from the rings; and an actuator mounted for pivotal movement relative to the housing about a pivot axis, the actuator comprising a pair of arms engageable with the hinge plates, the arms including a lower arm having a first contact surface engageable with the hinge plates during pivoting movement of the actuator in a first direction to move the rings from the closed position to the open position and an upper arm having a second contact surface engageable with the hinge plates during pivoting movement of the actuator in a second direction opposite said first direction to move the rings from the open position to the closed position, the first contact surface being spaced farther from the pivot axis than the second contact surface.

2. A ring binder mechanism as set forth in claim 1 wherein each of the upper and lower arms has a distal end, the distal end of the lower arm being spaced farther from the pivot axis than the distal end of the upper arm.

3. A ring binder mechanism as set forth in claim 1 wherein the lower arm is longer than the upper arm.

4. A ring binder mechanism as set forth in claim 1 wherein the upper and lower arms together define a notch, the hinge plates having ends that are received in the notch, the lower arm engaging the hinge plates during movement of the actuator in said first direction over a third contact surface, the third contact surface being on lower surfaces of the hinge plates, the upper arm engaging the hinge plates during movement of the actuator in said second direction over a fourth contact surface, the fourth contact surface being on upper surfaces of the hinge plates, the third contact surface being spaced farther from the ends of the hinge plates that are received in the notch than the fourth contact surface.

5. A ring binder mechanism as set forth in claim 1 wherein the upper and lower arms together define a notch and each of the hinge plates comprises a main body and a finger having an end received in the notch, the ends of the fingers being offset from the main body of the respective hinge plate.

6. A ring binder mechanism as set forth in claim 1 wherein the first contact surface is spaced at least about 6 mm away from the pivot axis.

7. A ring binder mechanism as set forth in claim 1 wherein the actuator is operable to move the rings from the closed position to the open position upon pivoting movement of the actuator in the first direction through an angle in the range of about 16 degrees to about 24 degrees.

8. A ring binder mechanism for holding loose-leaf pages, the mechanism comprising:

an elongate housing having a central portion and lateral sides extending downwardly along either side of the central portion;

a ring support comprising a pair of hinge plates in generally side-by-side relation and hingedly connected to one another for pivoting movement relative to each other, the hinge plates being held between the lateral sides of the housing;

a plurality of rings for holding the loose-leaf pages, each ring including a first ring member and a second ring member, the first ring member being mounted on the ring support for movement with the ring support relative to the housing between a closed position and an open position, in the closed position the first and second ring members forming a substantially continuous, closed loop for allowing loose-leaf pages retained by the rings to be moved along the rings from one ring member to the other, and in the open position the first and second ring members forming a discontinuous, open loop for adding or removing loose-leaf pages from the rings; and an actuator mounted for pivotal movement relative to the housing about a pivot axis, the actuator comprising a pair of arms engageable with the hinge plates, the arms including an upper and a lower arm defining a notch, the hinge plates having ends that are received in the notch, the lower arm having a contact surface engageable with the hinge plates during pivoting movement of the actuator to move the rings from the closed position to the open position, the contact surface being spaced at least about 6 mm away from the pivot axis.

9. A ring binder mechanism as set forth in claim 8 wherein the actuator is mounted at one end of the housing.

10. A ring binder mechanism as set forth in claim 8 wherein the actuator is operable to move the rings from the closed position to the open position upon pivoting movement of the actuator in the first direction through an angle in the range of about 16 degrees to about 24 degrees.

11. A ring binder mechanism for holding loose-leaf pages, the mechanism comprising:

an elongate housing having a central portion and lateral sides extending downwardly along either side of the central portion;

a ring support comprising a pair of hinge plates in generally side-by-side relation and hingedly connected to one another for pivoting movement relative to each other, the hinge plates being held between the lateral sides of the housing;

a plurality of rings for holding the loose-leaf pages, each ring including a first ring member and a second ring member, the first ring member being mounted on the ring support for movement with the ring support relative to the housing between a closed position and an open position, in the closed position the first and second ring members forming a substantially continuous, closed loop for allowing loose-leaf pages retained by the rings to be moved along the rings from one ring member to the other, and in the open position the first and second ring members forming a discontinuous, open loop for adding or removing loose-leaf pages from the rings; and an actuator mounted for pivotal movement relative to the housing about a pivot axis, the actuator comprising an arm engageable with the hinge plates to move the rings from the closed position to the open position, the actuator being configured so movement of the rings from the closed position to the open position is completed upon pivoting movement of the actuator through an angle in the range of about 16 degrees to about 24 degrees.

12. A ring binder mechanism as set forth in claim 11 wherein said arm is a lower arm, the actuator further comprising an upper arm engageable with the hinge plates to close the rings, each of the upper and lower arms having a distal end, the distal end of the lower arm being spaced farther from the pivot axis than the distal end of the upper arm.

13. A ring binder mechanism as set forth in claim 12 wherein the lower arm is longer than the upper arm.

14. A ring binder mechanism as set forth in claim 12 wherein the upper and lower arms together define a notch, the hinge plates having ends that are received in the notch.

15. A ring binder mechanism as set forth in claim 11 wherein the housing is configured to limit further pivoting movement of the actuator upon completion of the movement of the rings from the closed position to the open position by the actuator.

* * * * *